US008171766B1

(12) United States Patent
Slavik

(10) Patent No.: US 8,171,766 B1
(45) Date of Patent: May 8, 2012

(54) PASS THROUGH INLINE SEAM ROLLFORMER

(75) Inventor: Larry Slavik, St. Louis, MO (US)

(73) Assignee: Active Systems, Inc., St. Louis, MO (US)

( * ) Notice: Subject to any disclaimer, the term of this patent is extended or adjusted under 35 U.S.C. 154(b) by 781 days.

(21) Appl. No.: 12/313,793

(22) Filed: Nov. 25, 2008

Related U.S. Application Data

(60) Provisional application No. 61/004,634, filed on Nov. 30, 2007.

(51) Int. Cl.
*B21B 15/00* (2006.01)

(52) U.S. Cl. ..... 72/177; 72/179; 72/182

(58) Field of Classification Search ..... 72/419–421, 72/176–182, 446, 441; 29/33 Q, 335, 404, 29/405.01
See application file for complete search history.

(56) References Cited

U.S. PATENT DOCUMENTS 4,653,311 A * 3/1987 Tack, Jr. ..... 72/443
6,931,903 B2 * 8/2005 Knudson et al. ..... 72/181
2005/0252265 A1 * 11/2005 McDonald ..... 72/181
* cited by examiner

*Primary Examiner* — Edward Tolan
*Assistant Examiner* — Matthew G Katcoff
(74) *Attorney, Agent, or Firm* — Kevin L. Klug

(57) ABSTRACT

A pass through inline seam rollformer having a head assembly and a cradle moveably mounted with a frame. The head assembly laterally moves upon the cradle whereby a seam may be formed upon a sheet material via tooling mounted upon the head assembly. The cradle moves relative to said frame whereby the head assembly may be retracted from a pass line of the sheet material and the sheet material may move through the apparatus without interference from the head assembly. For the preferred embodiment, the tooling utilizes one or more rollers having circumferential grooves or profiles which allow a male or a female lock seam to be formed as the head assembly moves over a leading or trailing edge of the sheet material without the need to transfer the sheet material 90 degrees or remove the sheet material from a production line.

20 Claims, 30 Drawing Sheets

Fig. 1 - Prior Art

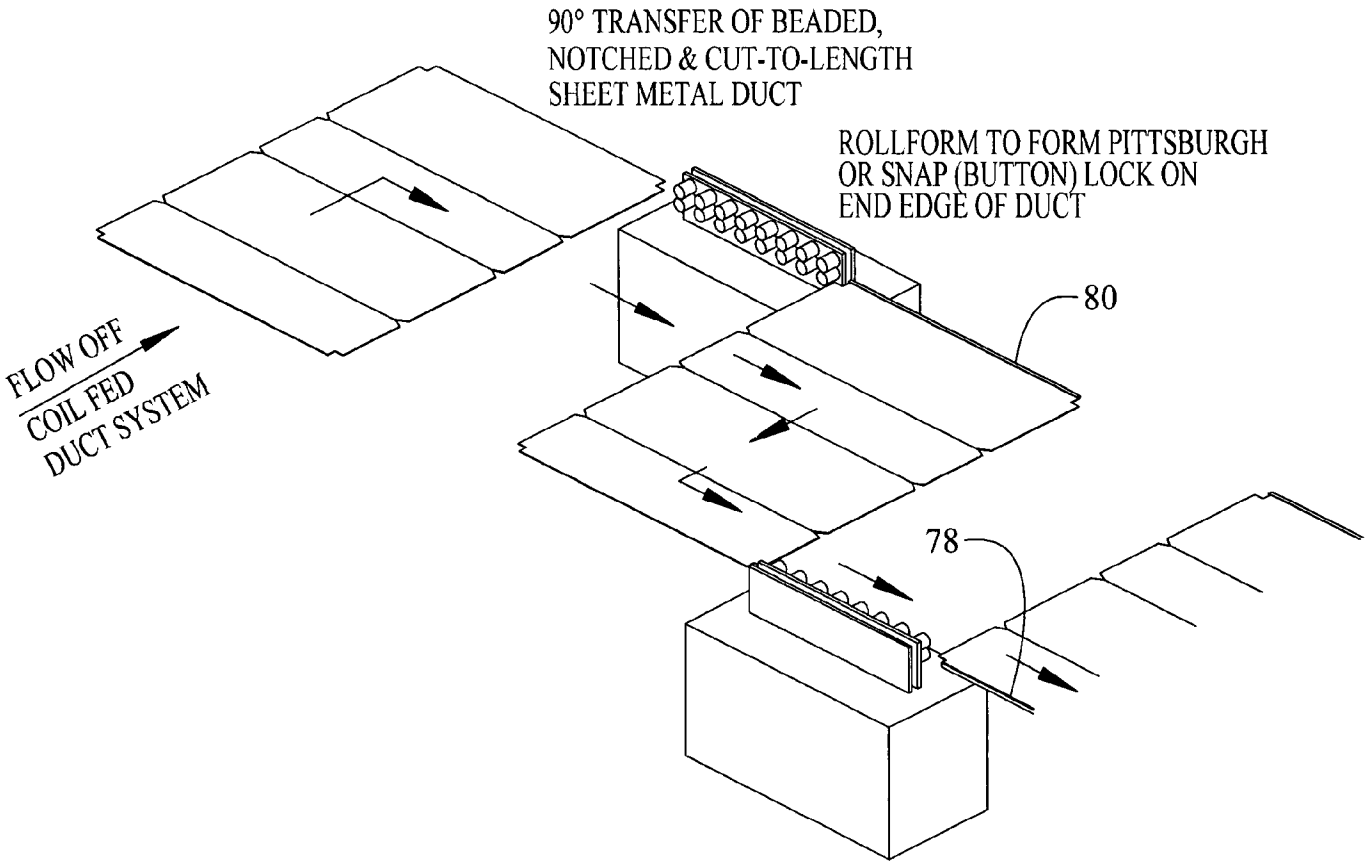
Fig. 7 - Prior Art

PASS THROUGH INLINE SEAM ROLLFORMER

This application claims priority of U.S. Provisional Patent Application No. 61/004,634, filed Nov. 30, 2007, entitled Pass Through Inline Seam Rollformer.

BACKGROUND OF THE INVENTION

The art of the present invention relates to sheet material or sheet metal seam or joint forming equipment in general and more specifically to a pass through inline seam rollformer capable of forming male and/or female lock seams in a single pass without an unnecessary lateral or horizontal movement of the sheet material, all while maintaining a minimum of floor space. The process of passing sheet material through consecutive sets of rollers, dies, or tooling with each performing an incremental part of a bend on the material to form a desired cross-sectional profile is known within the pertinent arts as "rollforming".

Sheet metal air ducts are manufactured in a plurality of styles and design configurations including but not limited to round, oval, square, and rectangular. Within the United States, ductwork and heating, ventilating, and air conditioning (HVAC) products are governed by standards set and recognized by the Sheet Metal and Air Conditioning Contractors National Association (SMACNA). Formation of said ducts and sheet metal fittings utilize a wide variety of locking, joining, and flanging methods which are produced by shearing, notching, and folding sheets of sheet metal or other sheet material. Often said sheets are formed and/or fed from a coil of sheet metal material.

Smaller heating and air conditioning contractors often utilize simple shears, brakes and lock seam rollformers to manufacture ductwork and associated fittings from pre-cut sheet metal. This prior art method is often time consuming and costly. As production volume and demand increase, contractors seek equipment and items which reduce labor cost and increase production capabilities, often in the form of automatic or semi-automatic coil fed duct forming equipment. Some ductwork manufacturers produce duct primarily for the residential (i.e. new homes) and light commercial (i.e. stores and offices) markets while other duct manufacturers fabricate for the light to heavy industrial and major commercial markets. Each contractor or manufacturer has special needs for improvement of the production process in the early stages of duct fabrication.

For square or rectangular ductwork, a fully automated duct forming system (See FIG. 1) beads, notches, and shears sheet metal stock to size, (See FIG. 2) rollforms each seam that joins the square or rectangular ducts together, then rollforms the end flanges that join each completed duct section together when they are assembled and hung. After all of the seams and flanges are formed, the duct sections are often automatically glued, insulated, and/or pinned. Thereafter, the insulated or non-insulated flat formed sections are folded to produce square and/or rectangular ductwork via two (2) piece or one (1) piece full wrapper duct sections. (See FIGS. 3 & 4)

A plurality of fully automated duct forming systems are fed from a coil of sheet metal with decoilers, straighteners, beaders, notchers, and shears performing operations on the sheet metal as it is fed through the automated duct system. (See FIG. 1) Sheets having notches, beads, and other attributes are formed (i.e. cut from the roll) with the automated duct system whereby "L" shaped or full wrapper square or rectangular ductwork is formed therefrom. Typically the ductwork seam is joined together by forming (i.e. rollforming) either a "pittsburg" or "snap lock" lock seam across the leading and trailing ends of the pre-cut and notched sheet metal. (See FIGS. 5 & 6) That is, a first end of the sheet metal is typically formed with a male "pittsburg" or "snap lock" and a second end is formed with the female "pittsburg" or "snap lock".

A fully automated duct forming system or line is highly desirable in order to minimize labor and fabrication time. Unfortunately, prior art fully automated duct forming systems have been prohibitively costly and utilize substantial floor space, all to the detriment of smaller or mid-size ductwork fabricators. Smaller manufacturers may minimize the capital costs of a fully automated duct forming system via utilization of a semi-automatic duct forming system yet often require the smallest footprint possible as their facilities may be limited in size. Even if a smaller manufacturer utilizes a semi-automatic duct forming system, the ability to integrate the semi-automatic system with or into a fully automated system is highly desired in order to meet future expansion and growth.

Additional capabilities for semi-automatic systems which improve throughput and reduce costs include equipment to seam or rollform the sides together, equipment to flange or rollform the ends, and equipment to fold the duct line into a two piece (i.e. "L" shape) or one piece four (4) sided duct (i.e. full wrapper). One of the most popular options for the semi-automatic duct forming line is the fold and shear equipment which folds a notched blank into an "L" or full wrapper shape prior to cutting to length. Unfortunately, the prior art fold and shear equipment requires rollforming of the seamed edge (i.e. the female "pittsburgh" or "snap lock") after the duct has been formed. This is often difficult and time consuming, especially when the duct is formed into a four sided full wrapper form.

With special modifications, some fold and shear equipment can form the male "pittsburgh" and male "snap lock" lock seams. Unfortunately, this often requires a 90 degree transfer of the wrapper duct into a rollformer or removal from the production line with the seamed edge produced on a manual feed rollformer. That is, the pre-notched sheet or pre-formed duct must be shuttled 90 degrees offline to rollform the "pittsburg" or "snap lock" seams on one or both ends of the duct. For the prior art, this 90 degree transfer is required on both fully automatic and semi-automatic fold and shear duct lines. (See FIGS. 1 & 7)

The present art represents a an inline pass through seam rollformer which travels across (i.e. laterally) the sheet material or metal rather than the sheet material passing through the rollformer. The male and female lock seams ("pittsburg", "snap lock", or other forms) are formed simultaneously in a single pass through operation while minimizing the floor space required for the present art apparatus.

The present art apparatus comprises a laterally moving rollforming head assembly having two or more distinct sets of outboard tooling or rollers mounted upon opposed spindles. In a preferred embodiment, the female lock seam is formed on a leading edge of a coil or sheet metal strip and the male lock seam is formed on the trailing edge of the pre-shear duct section as the head moves across the section. Alternative embodiments may reverse the female and male lock seam positioning on the leading and trailing edges.

The present art apparatus allows sheet material fed from a coil cradle to pass through a beader, notcher, and/or shear as necessary. The sheared sheets then proceed through the present art pass through inline seam rollformer where a pittsburgh, snap lock, or other type of seam is formed. Thereafter an edge flange rollformer is often utilized to flange the notched edge of the duct. If the duct requires insulation, a glue and insulation is applied and/or pinned to the sheared sheet.

An automatic brake finishes the sheared sheets by forming them into an "L" or full wrapper shape. Unique to the present art, all of the aforesaid is completed inline without a 90 degree transfer of any of the sheet material.

Accordingly, it is an object of the present invention to provide an inline pass through seam rollformer which utilizes a minimum of space yet is capable of forming male and/or female lock seams in a single pass without an unnecessary lateral or horizontal movement of the sheet material.

Another object of the present invention is to provide an inline pass through seam rollformer which is capable of simultaneously forming said lock seams in a single pass.

A further object of the present invention is to provide an inline pass through seam rollformer which is which is capable of utilization with a fully or semi automatic duct forming line whereby "L" shaped or full wrapper duct sections may be formed and finished.

SUMMARY OF THE INVENTION

In accordance with the present invention, the preferred embodiment represents an inline pass through seam rollformer which travels across (i.e. laterally) the sheet material or metal rather than the sheet material passing through the rollformer. (See FIGS. 8-23) The male and female lock seams ("pittsburg", "snap lock", or other forms) are formed simultaneously in a single pass through operation while minimizing the floor space required for the present art apparatus.

The present art apparatus comprises a laterally moving rollforming head assembly having two or more distinct sets of outboard tooling or rollers mounted upon opposed spindles. In a preferred embodiment, the female lock seam is formed on a leading edge of a coil or sheet metal strip and the male lock seam is formed on the trailing edge of the pre-shear duct section as the head moves across the section. Alternative embodiments may reverse the female and male lock seam positioning on the leading and trailing edges. Further alternative embodiments may utilize only a single tooling set mounted with said head which forms a male or female lock seam.

In the preferred embodiment, the spindles comprise upper spindles and lower spindles and are preferably coupled via mating spindle gears mounted onto each spindle. Preferably the spindle gears have a pitch and size which provides a one to one ratio of movement between the outboard tooling or rollers.

The head assembly moveably sits or rides upon one or more (preferably two) rails or guideways which are formed or mounted upon a cradle and which allow the lateral or horizontal movement of said head assembly during the seam or rollforming operation. In a preferred embodiment, one or more arms extend from said head and are sized to sit upon the rails and substantially position the head between said rails.

The preferred embodiment allows the head and tooling to move across the sheet material via the frictional contact of the tooling rollers with the sheet material. Alternative embodiments utilize a head assembly drive connected with said head to impart head movement across the sheet material.

The present art apparatus may be manufactured from a plurality of materials including metallic materials such as steel or aluminum, plastics, composites, and other materials capable of withstanding the compressive, lateral, and vertical forces. In the preferred embodiment, the inline pass through seam rollformer is manufactured from various alloys of steel.

BRIEF DESCRIPTION OF THE DRAWINGS

Numerous other objects, features, and advantages of the invention should now become apparent upon a reading of the following detailed description taken in conjunction with the accompanying drawings, in which:

FIG. 7 is a perspective view of a prior art seam formation system showing the 90 degree transfer of the sheet material.

DETAILED DESCRIPTION

Figure 1:
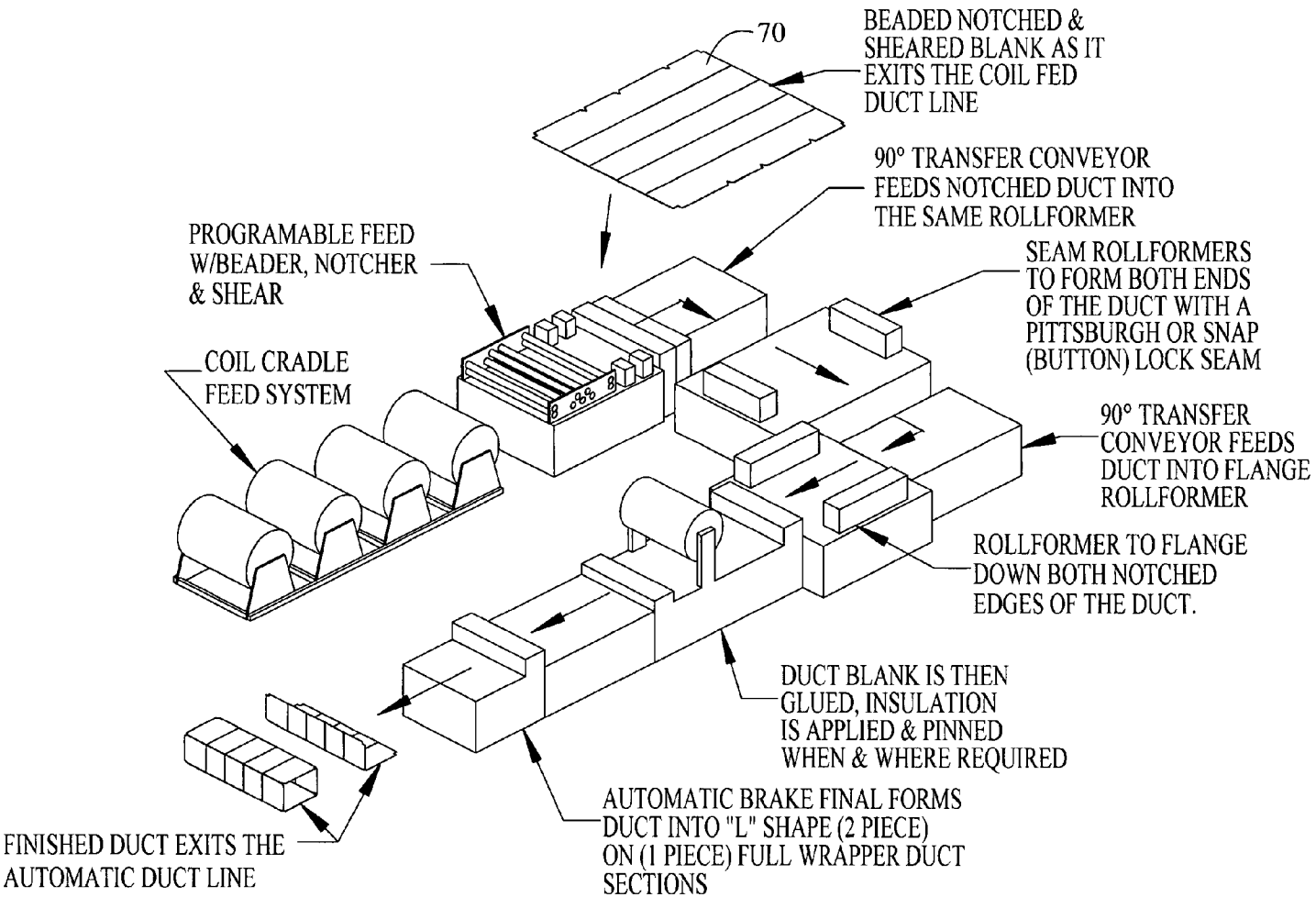
FIG. 1 is a perspective view of a prior art fully automatic duct system showing the requirement for a 90 degree transfer of the sheet material.
Figure 2:
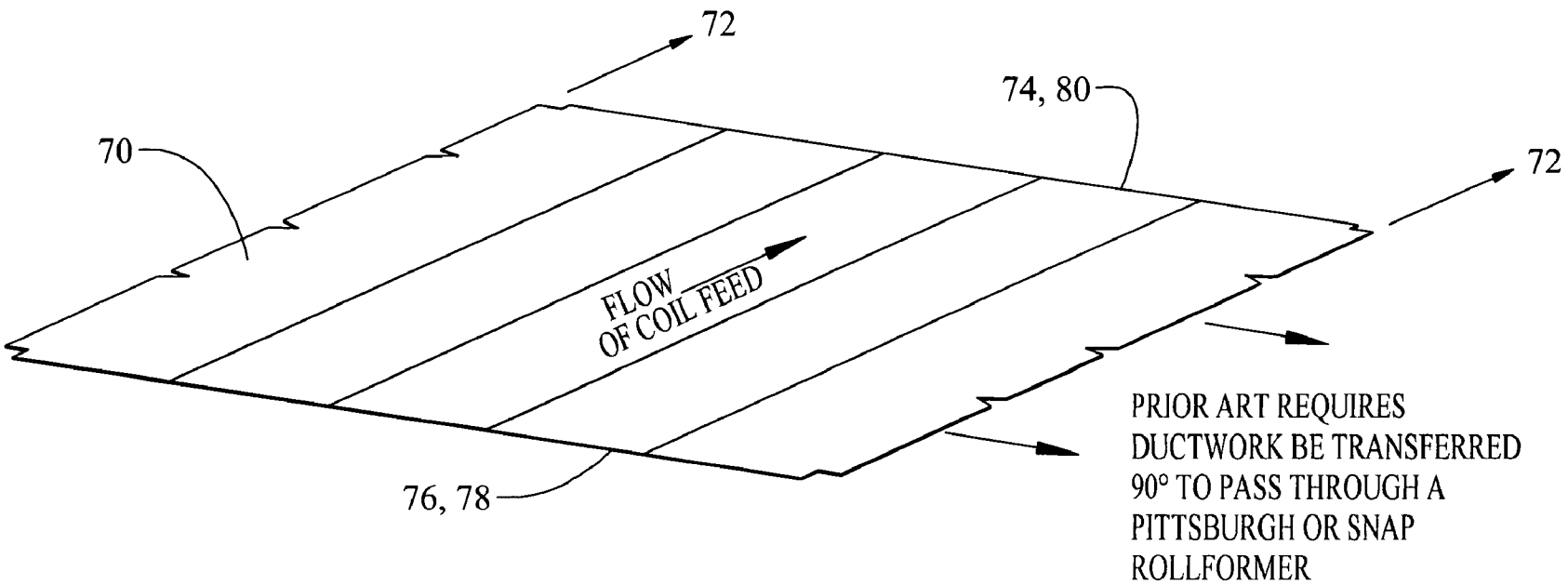
FIG. 2 is a perspective view of a sheet material flow, pass lines, and positioning of lock seams.
Figure 3:
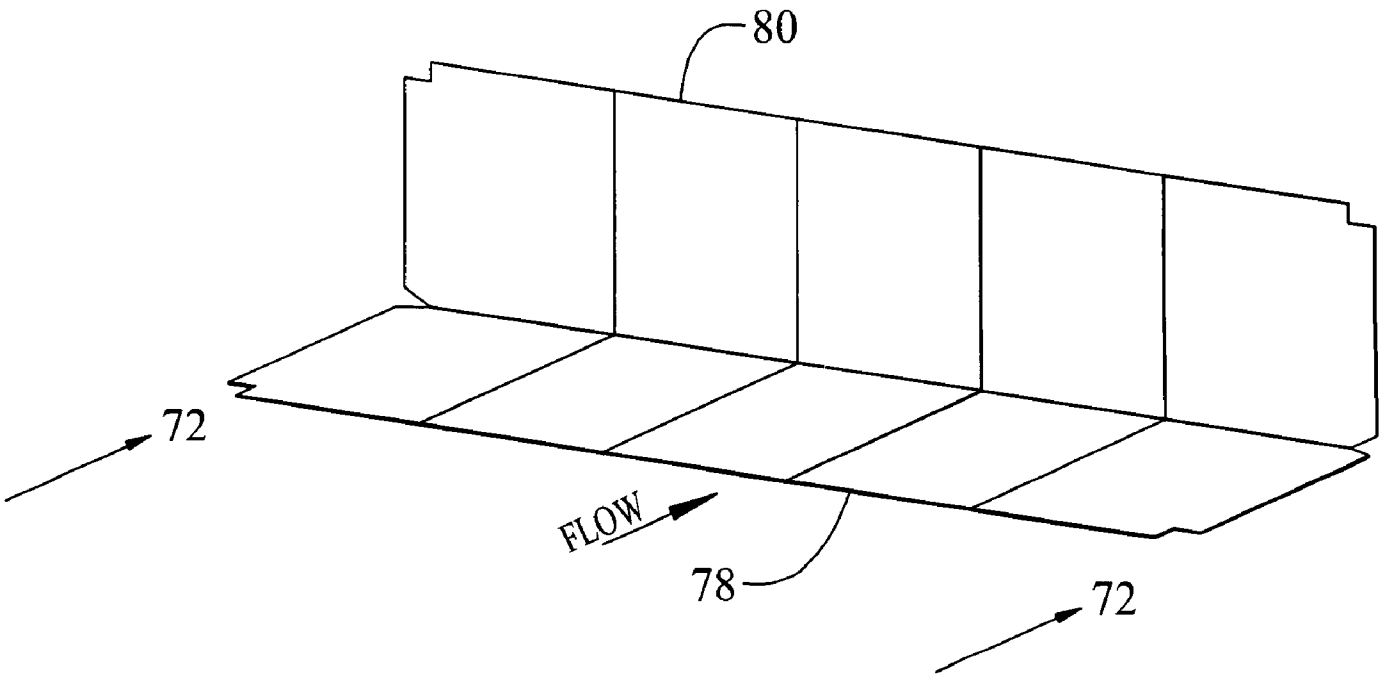
FIG. 3 is a perspective view of an "L" shaped duct section.
Figure 4:
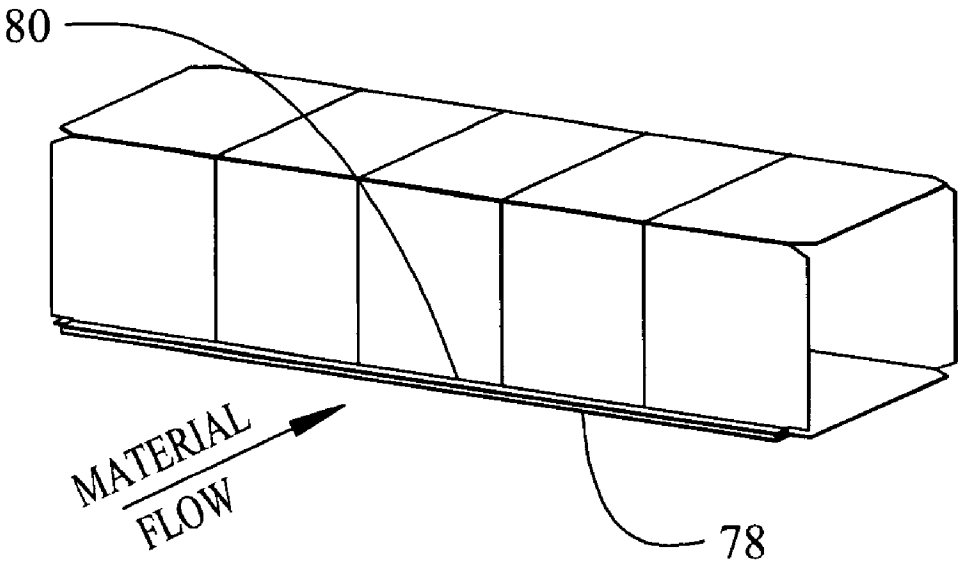
FIG. 4 is a perspective view of a one piece full wrapper duct section.
Figure 5A:
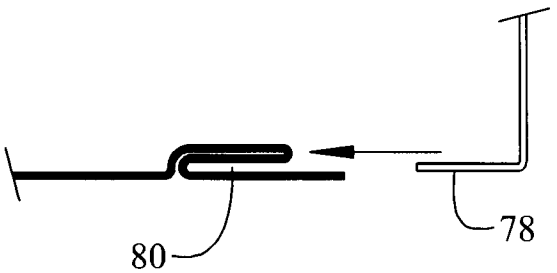
FIG. 5A is a side cross sectional view of a pittsburgh lock seam showing male and female portions separated.
Figure 5B:
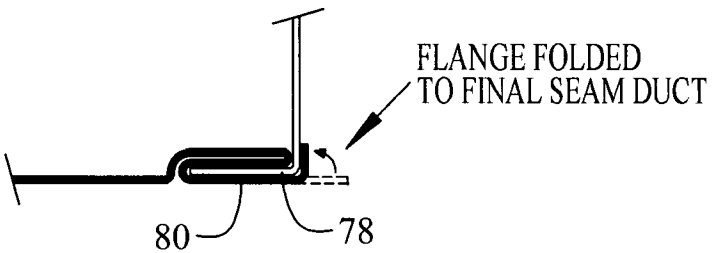
FIG. 5B is a side cross sectional view of a pittsburgh lock seam showing male and female portions joined and locked.
Figure 6A:
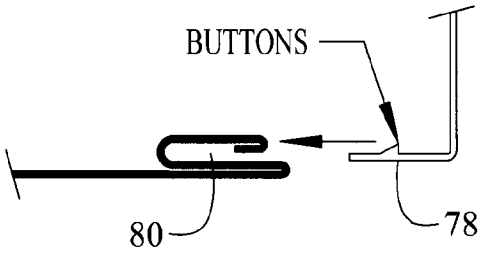
FIG. 6A is a side cross sectional view of a snap lock seam showing male and female portions separated.
Figure 6B:
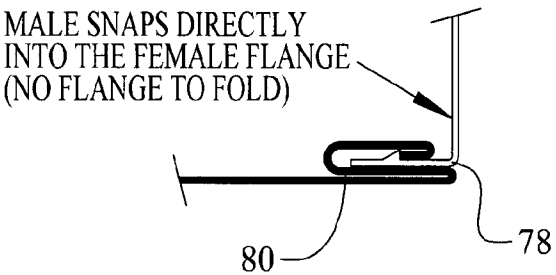
FIG. 6B is a side cross sectional view of a snap lock seam showing male and female portions joined and locked.
Figure 8:
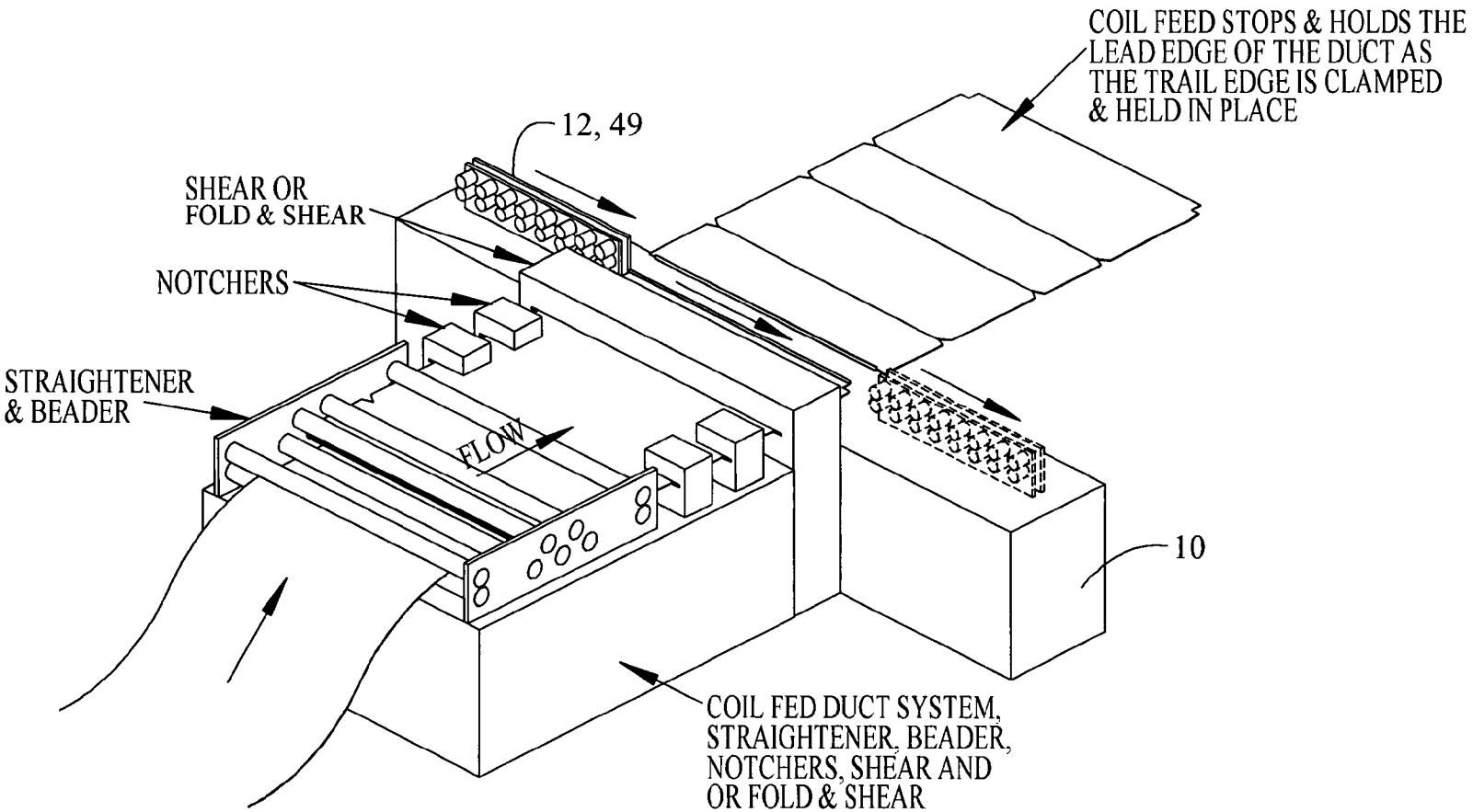
FIG. 8 is a perspective view of the present art pass through inline seam rollformer positioned relative to a feeding and notching system.
Figure 9:
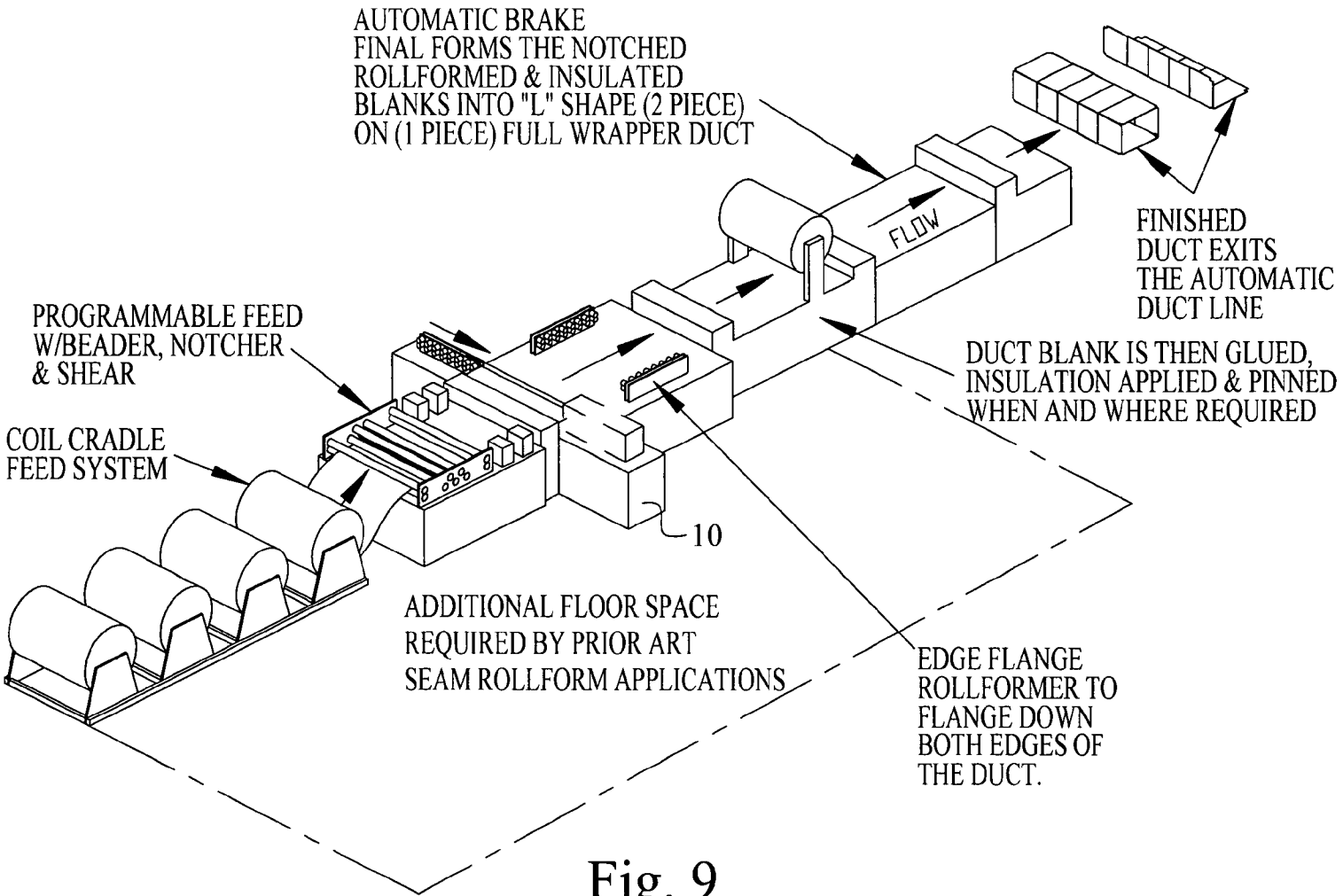
FIG. 9 is a perspective view of the present art pass through inline seam rollformer incorporated with a fully automatic duct system.
Figure 10:
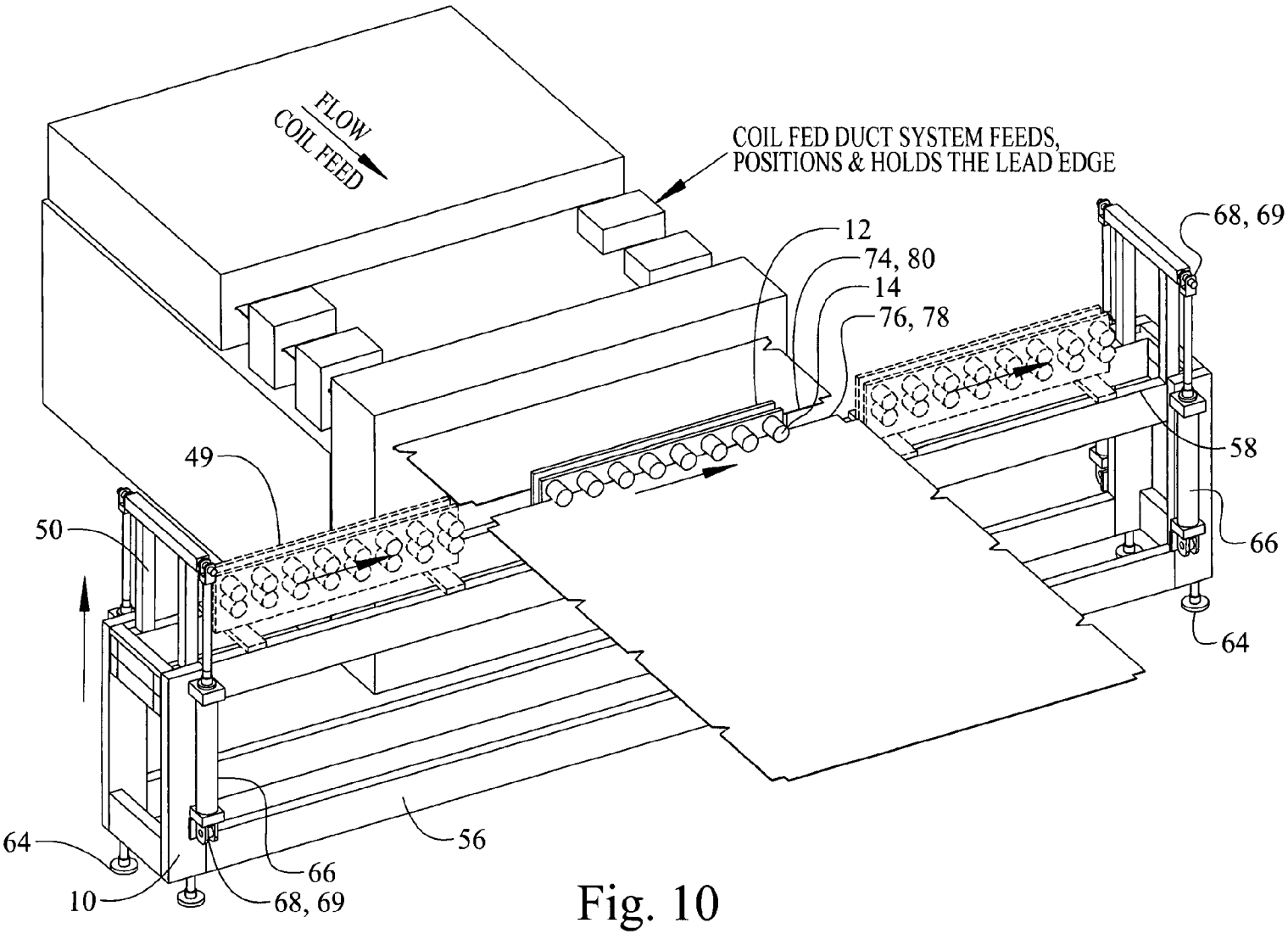
FIG. 10 is a front perspective view of the present art pass through inline seam rollformer fed with a feeding and notching system showing the head assembly as it forms the lock seams.
Figure 11:
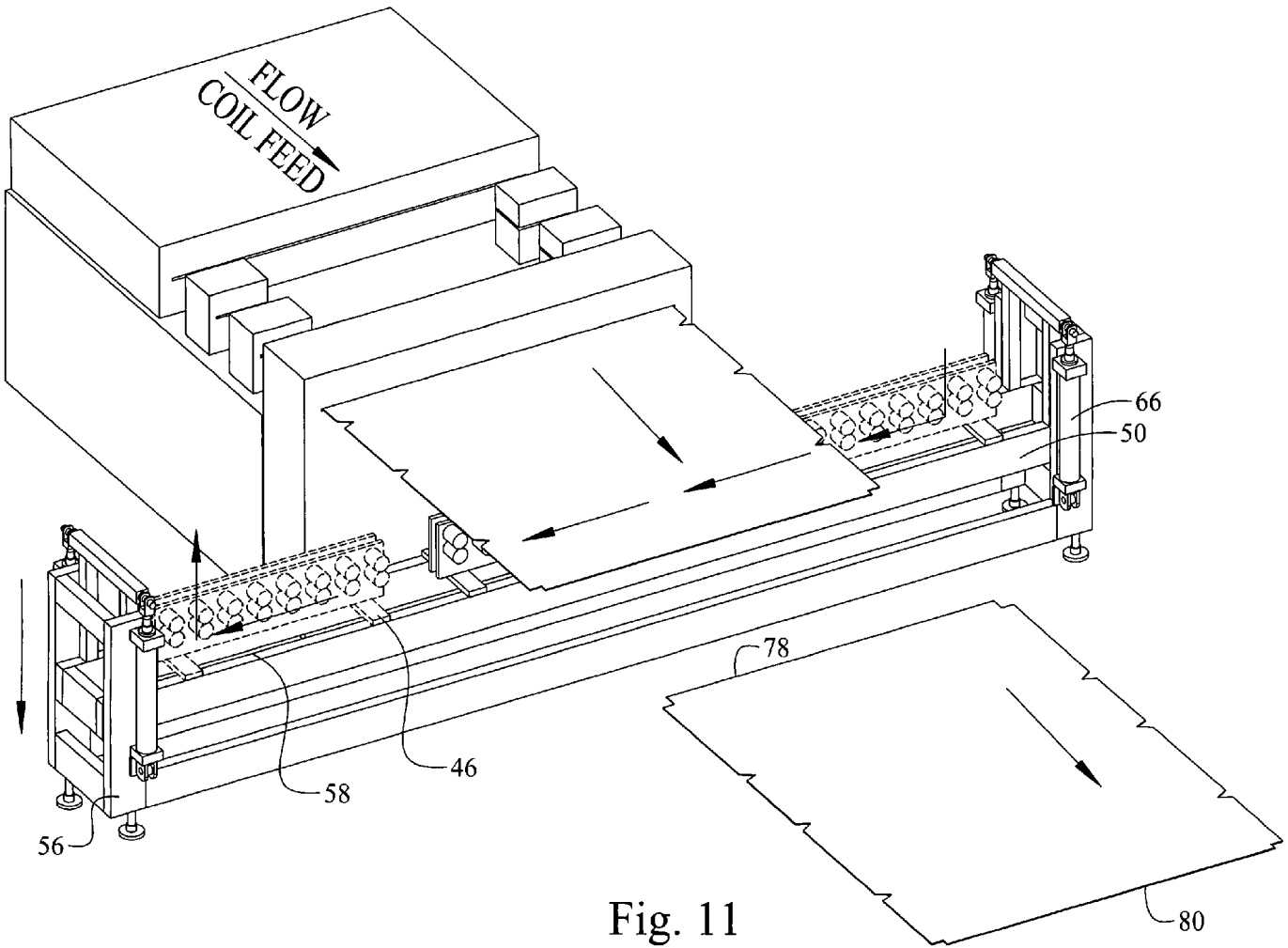
FIG. 11 is a front perspective view of the present art pass through inline seam rollformer fed with a feeding and notching system showing the head assembly as it retracts beneath a sheet material as the sheet material is fed.
Figures 12, 13:
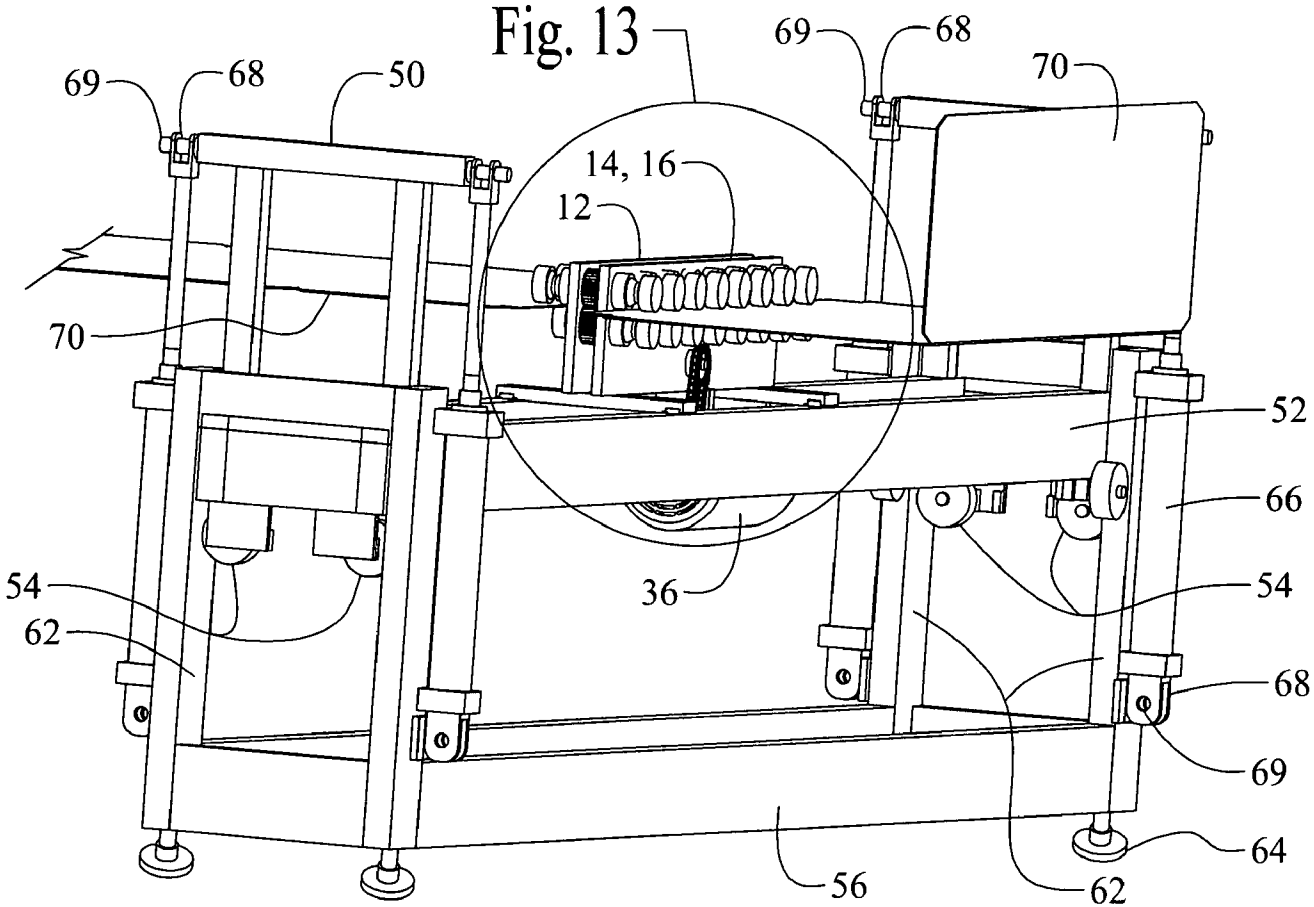
FIG. 12 is a front detailed perspective view of the present art pass through inline seam rollformer showing the relative positioning of the sheet material.
FIG. 13 is an enlarged view of section FIG. 13 of FIG. 12.
Figure 13:
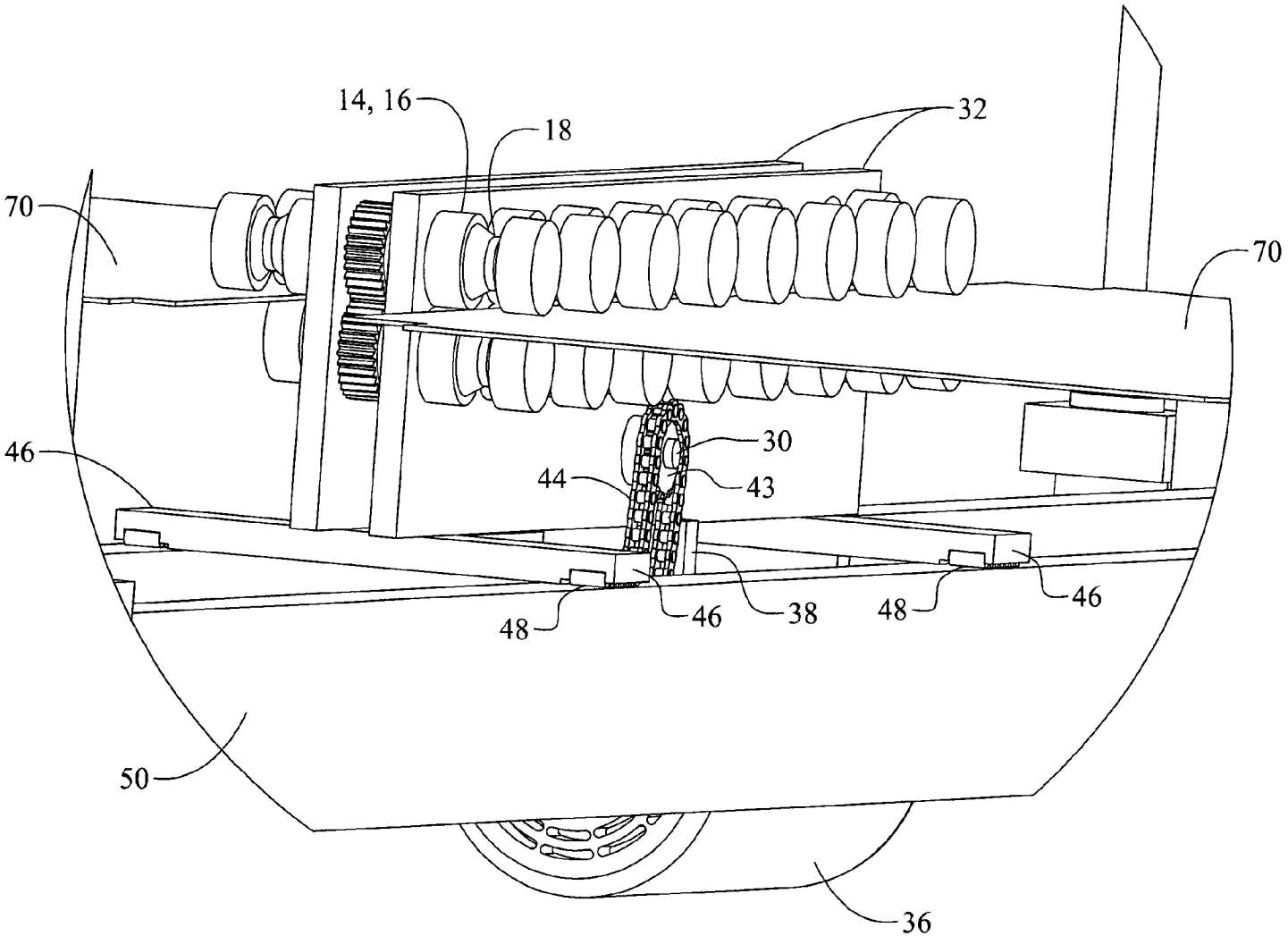
Figures 14, 15:
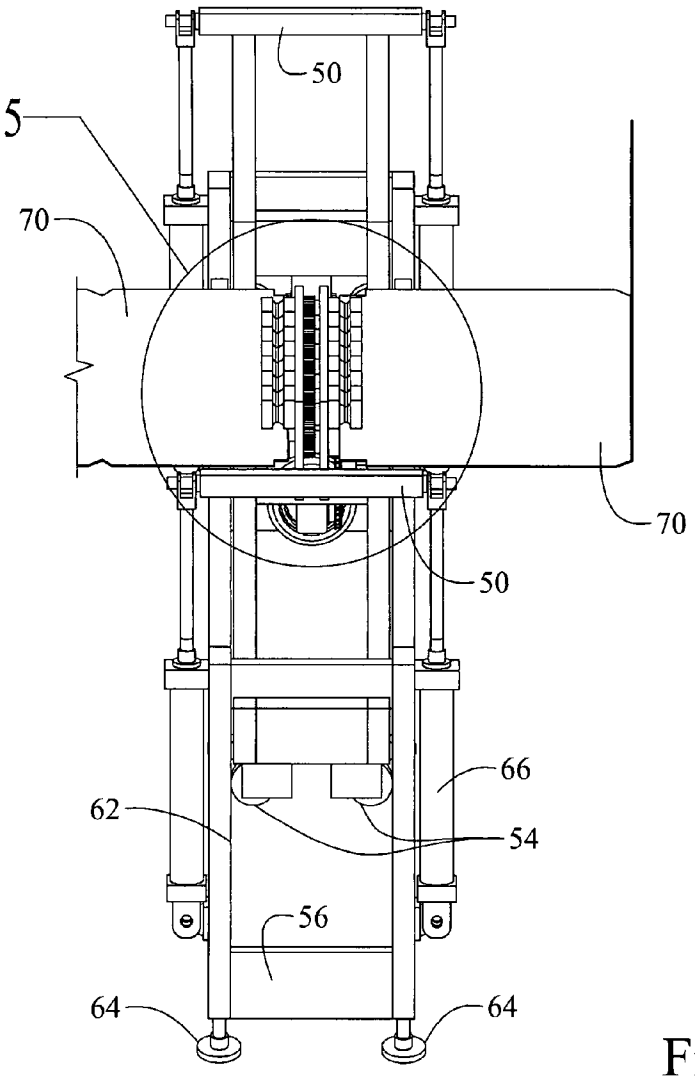
FIG. 14 is a left side detailed perspective view of the present art pass through inline seam rollformer with the head assembly in an elevated position showing the relative positioning of the sheet material.
FIG. 15 is an enlarged view of section FIG. 15 of FIG. 14.
Figure 15:
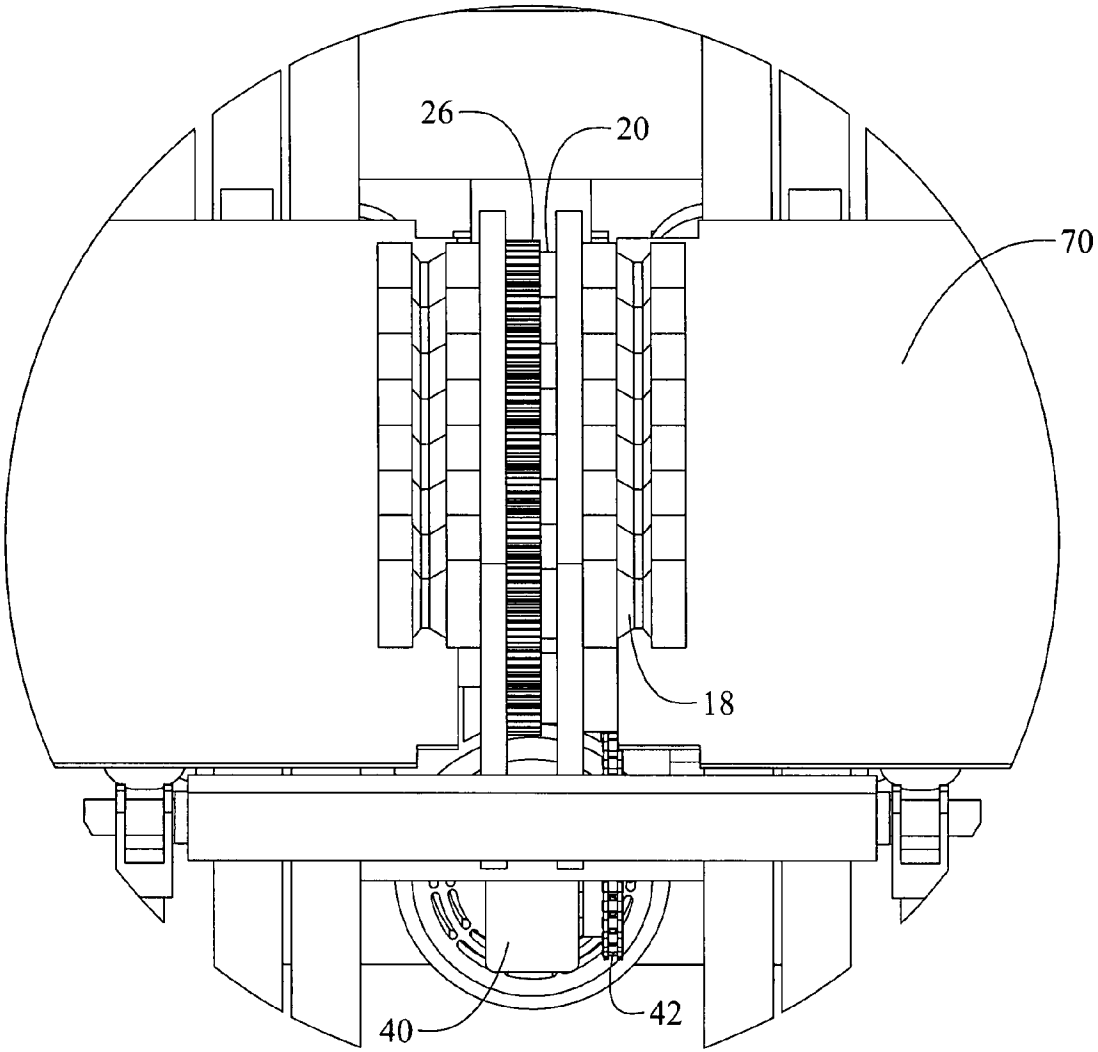
Figure 16:
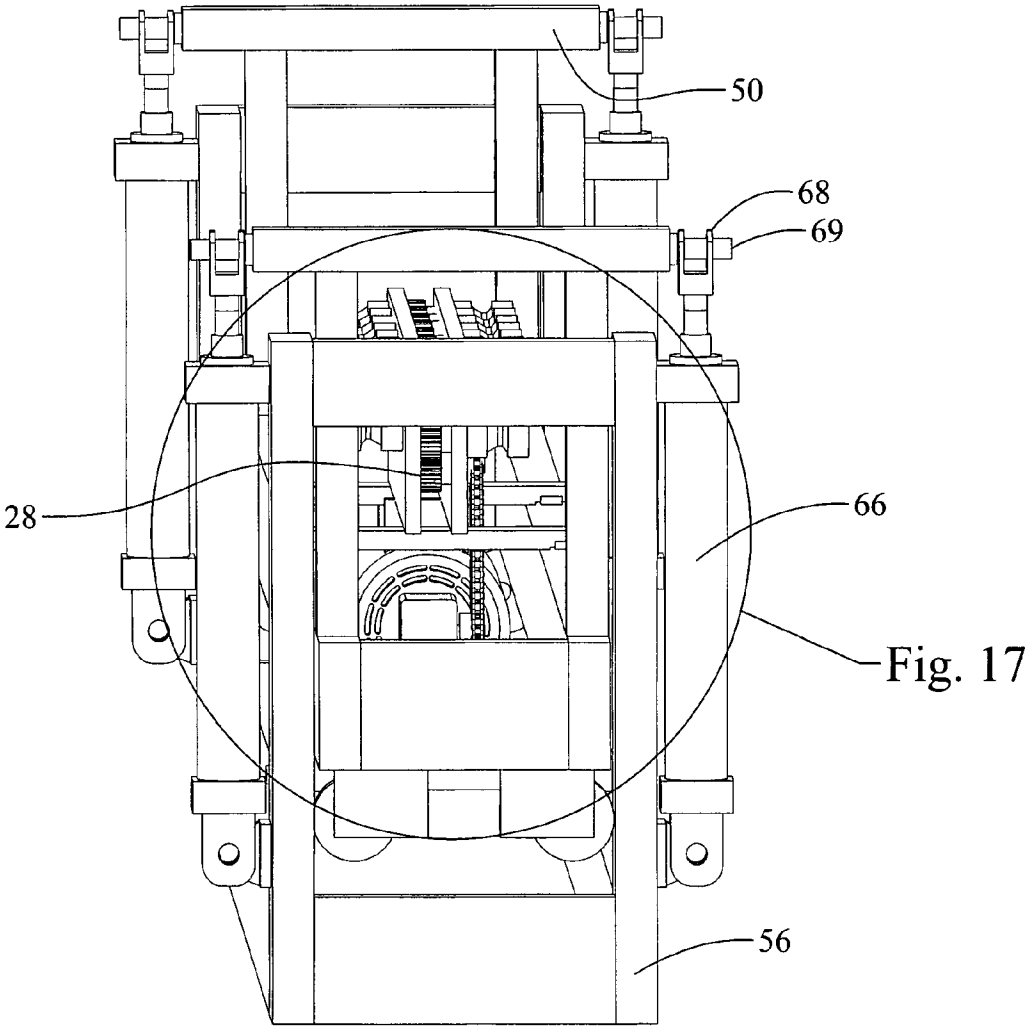
FIG. 16 is another left side perspective view of the present art pass through inline seam rollformer with the head assembly in a lowered position without sheet material.
Figure 17:
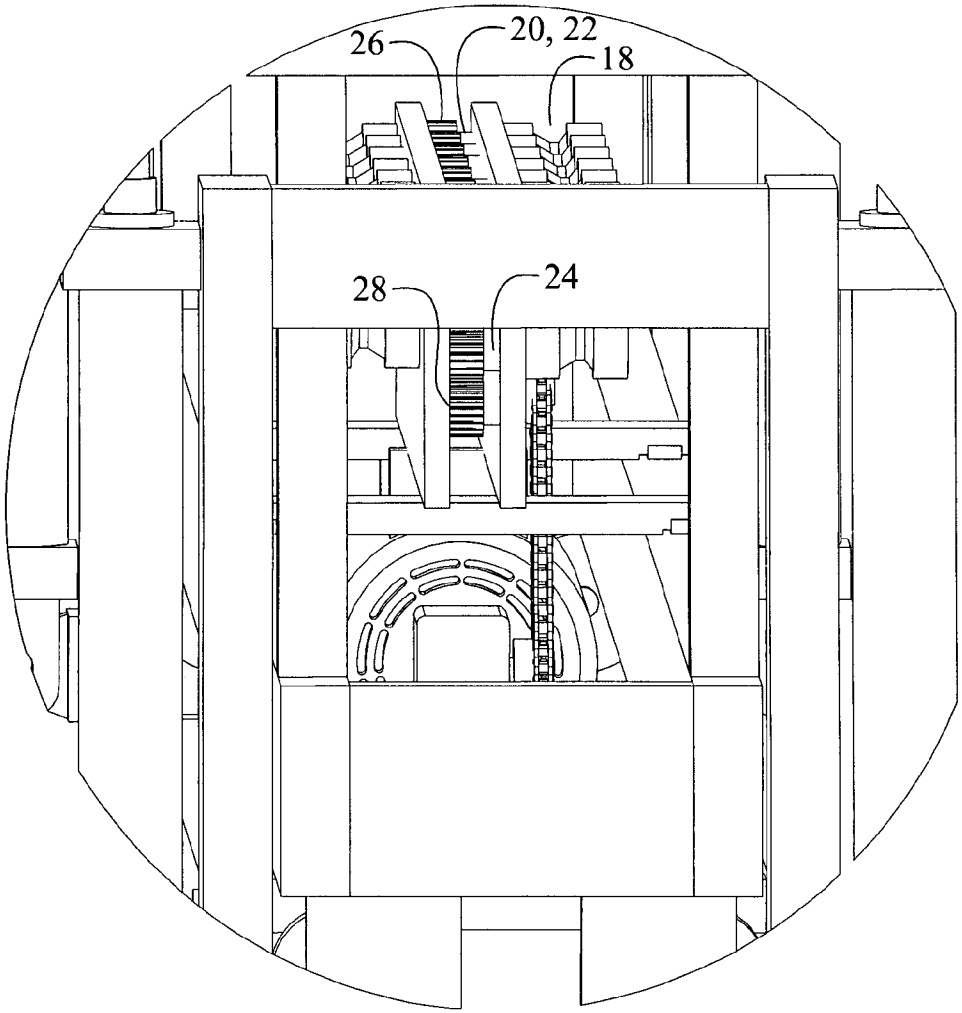
FIG. 17 is an enlarged view of section FIG. 17 of FIG. 16.
Figure 18:
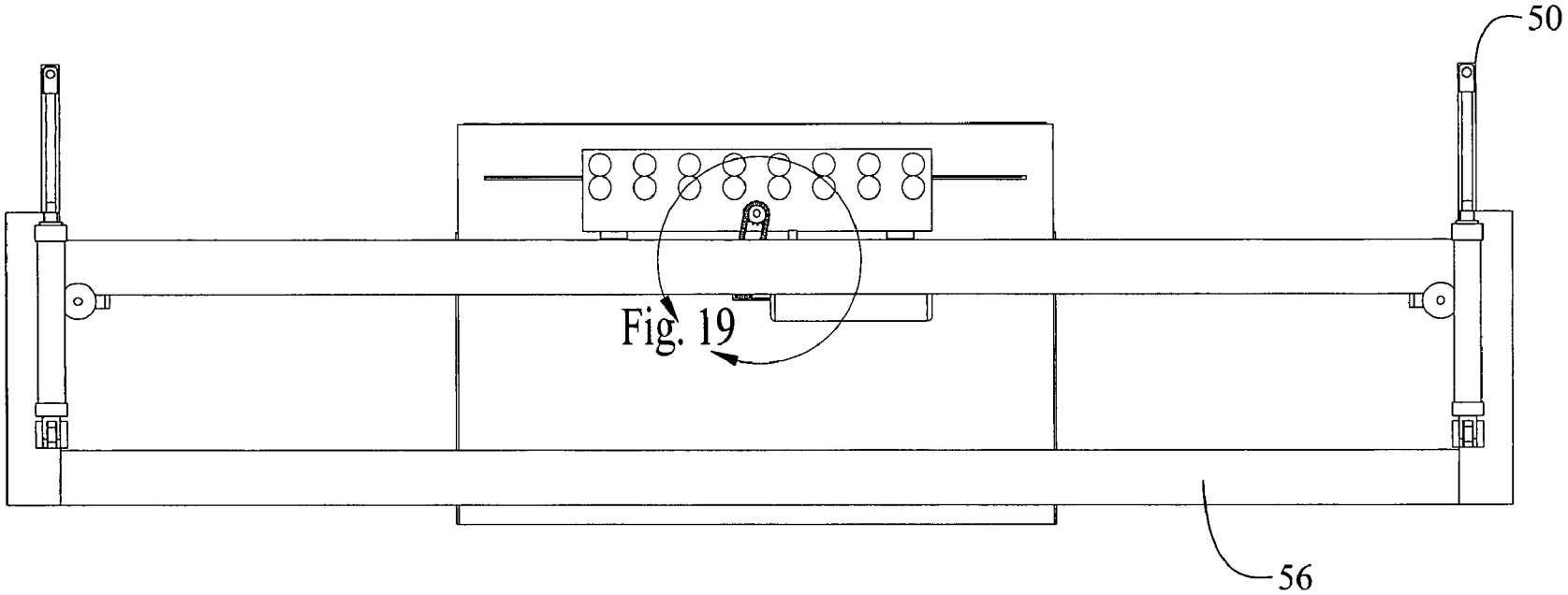
FIG. 18 is a front plan view of the present art pass through inline seam rollformer with the head assembly in an elevated position.
Figure 19:
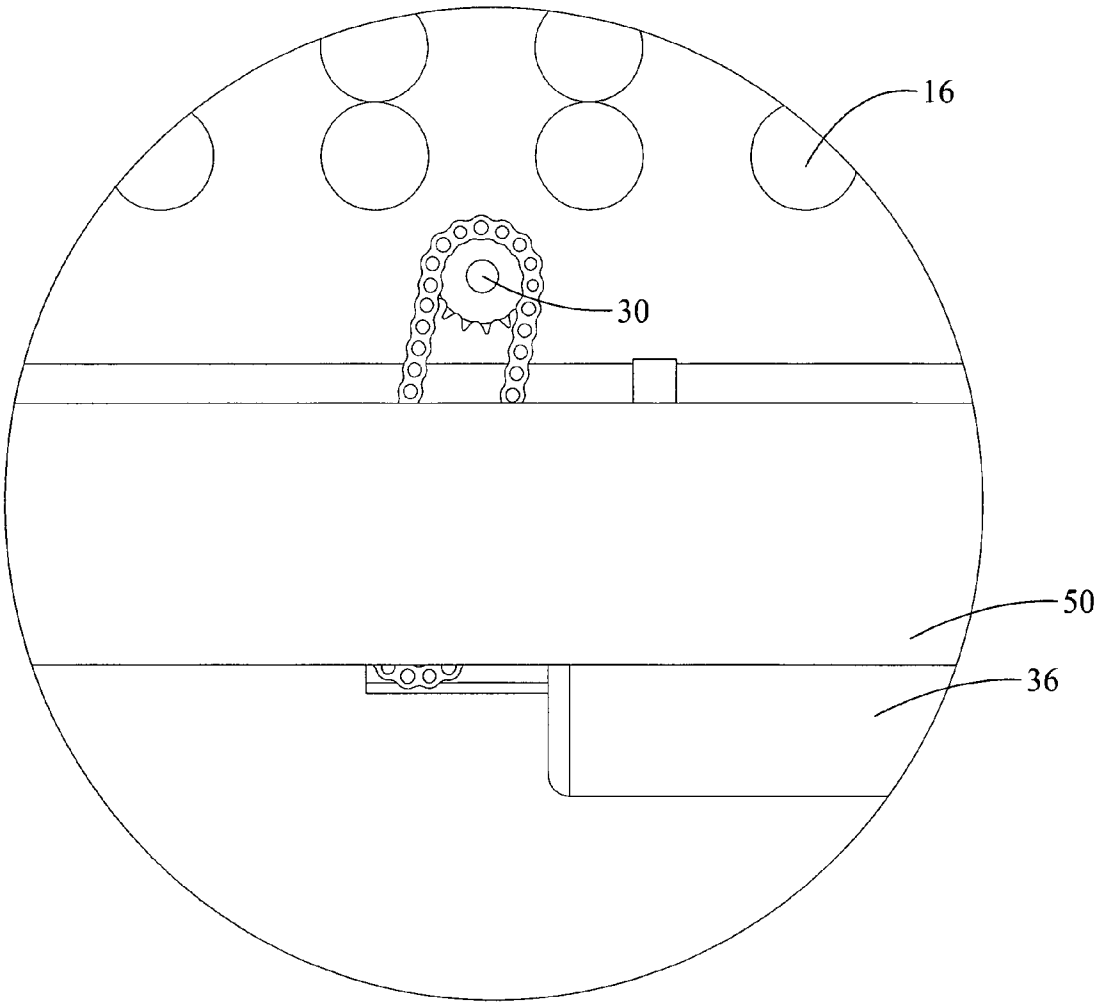
FIG. 19 is an enlarged view of section FIG. 19 of FIG. 18.
Figure 20:
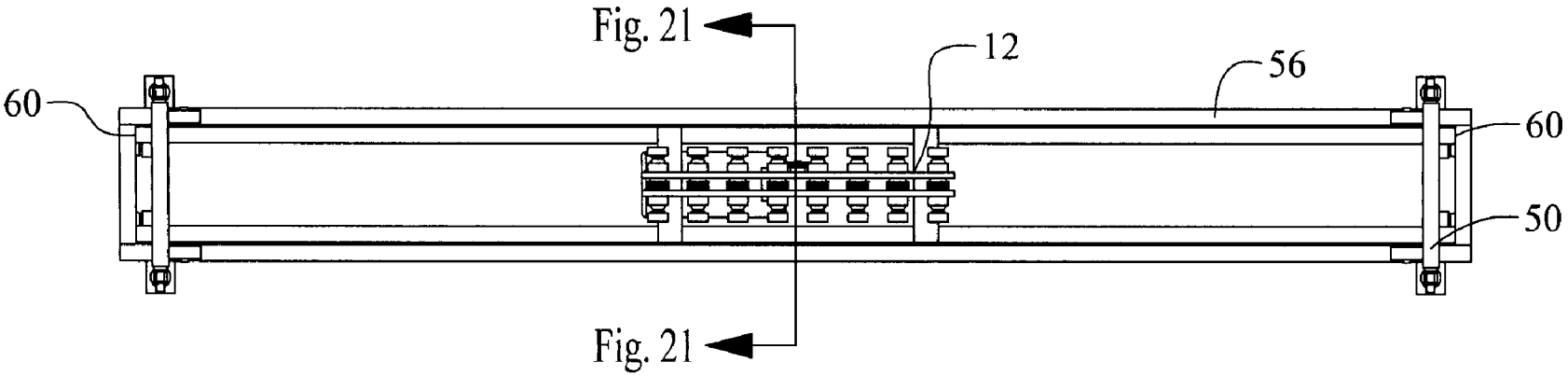
FIG. 20 is a top plan view of the present art pass through inline seam rollformer without sheet material loaded into the apparatus.
Figure 21:
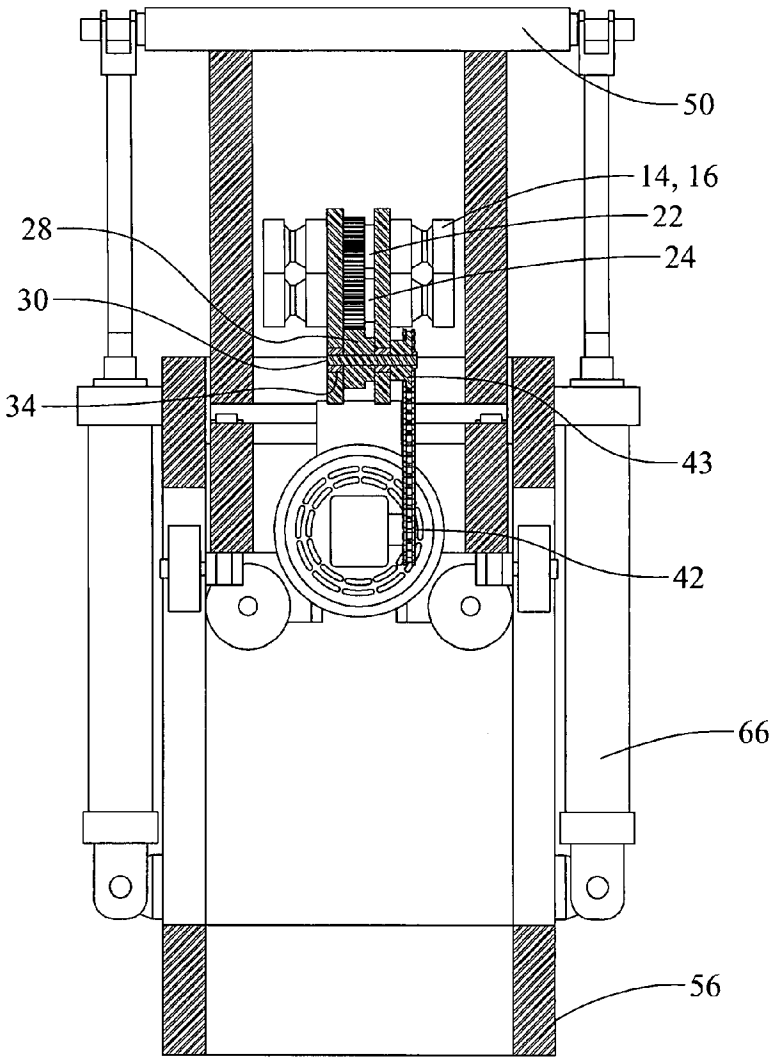
FIG. 21 is a cross sectional view of the head assembly taken along lines 21-21 of FIG. 20.

Referring now to the drawings, there is shown in FIGS. 1-23 a preferred embodiment of the pass through inline seam rollformer 10 and in FIGS. 24-30 an alternative embodiment thereof.

The present art represents an inline pass through seam rollformer 10 which travels across (i.e. laterally) the sheet material 70 or metal rather than the sheet material 70 passing through the rollformer. (See FIGS. 8-23) The male 78 and female 80 lock seams ("pittsburg", "snap lock", or other forms) are formed simultaneously in a single pass through operation while minimizing the floor space required for the present art apparatus 10.

The present art apparatus 10 comprises a laterally moving rollforming head assembly 12 having two or more distinct sets of outboard tooling 14 or rollers 16 mounted upon opposed spindles 20. In a preferred embodiment, the female lock seam 80 is formed on a leading edge of a coil or sheet 70 metal strip and the male lock seam 78 is formed on the trailing edge of the pre-shear duct section as the head 12 moves across the section. Alternative embodiments may reverse the female 80 and male 78 lock seam positioning on the leading and trailing edges. Further alternative embodiments may utilize only a single tooling 14 set mounted with said head 12 which forms a male 78 or female 80 lock seam.

Said tooling 14 is recognized within the pertinent arts and typically comprises one or more rollers 16 (generally a plurality of rollers) which have appropriate circumferential grooves or profiles 18. The rollers 16 progressively form a male 78 or female 80 lockseam onto the sheet material which passes there through. Further alternative embodiments may utilize tooling 14 in the form of dies or other types of seam formers which are affixed substantially stationary with said head 12 without a rotary motion.

In a preferred embodiment, said head assembly 12 has one or more motors 36 which are mechanically and rotationally connected with said tooling 14 (i.e. rollers 16) whereby rotation is imparted to the tooling 14. Said motor(s) 36 may take the form of electrical, hydraulic, pneumatic, manual, or other rotational devices capable of producing a rotational mechanical torque. Said motor 36 is preferably mounted below and with said head 12 via a motor mount 38 with alternative embodiments mounting said motor 36 in a plurality of positions relative to said head 12 provided a rotational torque is transferred to said rollers 16. In a preferred embodiment, said rotational mechanical connection takes the form of a first sprocket 42 mounted upon a shaft of a right angle gear reducer 40 connected with said motor 36 and a second sprocket 43 mounted with said head assembly 12, all of which are coupled via a mating chain 44. Said sprockets 42, 43 may be of different sizes or said motor 36 may directly drive said tooling 14, as desired by the user or as necessary to obtain the tooling 14 speed and torque desired. Alternative embodiments may utilize a plurality of mechanical couplings, including but not limited to geared couplings, rigid or flexible shaft couplings, or other recognized rotation couplings.

In the preferred embodiment, the spindles 20 comprise upper spindles 22 and lower spindles 24 and are preferably coupled via mating spindle gears 26 mounted onto each spindle 20. Preferably the spindle gears 26 have a pitch and size which provides a one to one ratio of movement between the outboard tooling 14 or rollers 16. One or more idler gears 28, of preferably the same diameter and pitch as the spindle gears 26, are rotationally mounted with the head 12 and placed substantially between each spindle gear 26. For the preferred embodiment, the idler gears 28 couple each lower spindle 24 with the laterally adjacent lower spindle 24 by engaging or meshing with the spindle gears 26. When the aforesaid gears 26, 28 are properly mated with a minimum of lash, rotational motion imparted to a single idler gear 28, spindle gear 26, or spindle 20 imparts a substantially equal rotational velocity to all spindles 20 and tooling 14. The preferred embodiment, as shown in the drawings, utilizes a drive shaft 30 connected with one of said idler gears 28, said drive shaft 30 having said second sprocket 43 attached with or near an end of said shaft 30. Alternative embodiments may couple said spindles 20 via a plurality of means, including but not limited to chains, gears, or belts.

In a preferred embodiment, said head assembly 12 comprises two plates 32, between which is mounted said idler gears 28 with said spindles 20 extending there through. Each spindle 20 extends through said plates 32 with said tooling 14 mounted near or at the ends of said spindles 20. Preferably, each spindle 20 and/or drive shaft 30 is rotatably mounted with said plates 32 via bearings 34 held with said plates 32 and through and into which said spindles 20 or drive shaft 30 are fitted. Said bearings 34 may take a plurality of forms including but not limited to roller, ball, babbot, bronze, metal to metal contact, or other forms.

The head assembly 12 moveably sits or rides upon one or more (preferably two) rails 58 or guideways which are formed or mounted upon a cradle 50 and which allow the lateral or horizontal movement of said head assembly 12 during the seam or rollforming operation. In a preferred embodiment, one or more arms 46 extend from said head 12 and are sized to sit upon the rails 58 and substantially position the head 12 between said rails 58. Also in a preferred embodiment, each extension arm 46 has a linear bearing 48 between each arm 46 and rail 58 which moveably seats upon said rail 58 and allows easy lateral or horizontal movement of said head 12 with a minimum of application force. Alternative embodiments may forego use of the linear bearings 48 and utilize a plurality of other head 12 to rail 58 or guideway interfaces, including but not limited to lubricated metal to metal contacts, slides, or roller beds.

The cradle 50 moveable mates with a frame 56 and has one or more (preferably four) linear actuators 66 or lifting mechanisms connected with and between said frame 56 and cradle 50 which allow the combination of cradle 50 and head 12 to move vertically or substantially perpendicular to the sheet material 70 and head 12 movement. The vertical or perpendicular movement allows the head 12 to retract laterally and below (or away from) the sheet material 70 after a seam or rollforming operation is completed while the sheet material 70 is advancing. That is, the head assembly 12 and cradle 50 is lowered, via the action of the linear actuators 66 or lifting mechanisms, below the sheet material 70 before retracting. When fully retracted, the head 12 and cradle 50 is raised, via the action of the linear actuators 66, and ready for lateral movement whereby another seam 78, 80 may be formed. Said linear actuators 66 are preferably hydraulic cylinders but may take a plurality of forms in alternative embodiments, including but not limited to pneumatic actuators, electric linear actuators, direct gear drives, lead screws, cable hoists, or chain drives. The actuators 66 are connected with said frame 56 and cradle 50 via a clevis 68 and through pin or shaft 69 in a preferred embodiment, but may utilize a plurality of other types of connections for alternative embodiments, including but not limited to ball joints or a direct seat or contact between the frame 56 and cradle 50.

The preferred embodiment allows the head 12 and tooling 14 to move across the sheet material 70 via the frictional contact of the tooling rollers 16 with the sheet material 70. Alternative embodiments utilize a head assembly 12 drive connected with said head 12 to impart head 12 movement across the sheet material 70. Said head 12 drive may include but is not limited to a motorized drive wheel or gear on said head 12 which is mated with said cradle 50, a motorized chain and sprocket between said head 12 and cradle 50, a motorized belt and pulley between said head 12 and cradle 50 or a motorized lead screw drive between said head 12 and cradle 50.

In a preferred embodiment, the cradle 50 comprises a substantially rectangular frame 52 having cradle rollers 54 attached near the corners or ends of the rectangular form. Said cradle rollers 54 are adjustable whereby precise positioning of the cradle 50 within the frame 52 is achieved while maintaining cradle 50 movability in a substantially vertical plane or a plane substantially perpendicular to the sheet material 70. Also in the preferred embodiment, the frame 56 comprises a substantially "U" shaped form 60 at each end or side outside of the pass line 72 of the sheet material 70 and within which the cradle 50 is contained. Each "U" shaped form 60 has one or more surfaces 62 onto which the cradle rollers 54 contact and ride. Also in the preferred embodiment, one or more height adjusters 64 are placed at or near each bottommost corner or end of the frame 56 whereby the frame 56 height may be adjusted and leveled.

The present art allows quick interchange of the head assembly 12 with the cradle 50. That is, the head assembly 12 may be lifted from the rails 58 of said cradle 50 with a simple disconnection of a cord from the motor 36. This attribute is especially useful when the user desires to apply different types of seams. Alternative embodiments (See FIGS. 24-30) incorporate tandem 15 head assemblies 12 which allow formation of different types of seams. That is, a set of tooling 14 or rollers 16 are positioned in a substantially vertical relation to one another and move horizontally or laterally relative to the sheet material 70. With the aforesaid alternative embodiment, a different type of seam may be formed by simply positioning the cradle 50, via said actuators 66, at a different height. Further alternative embodiments may incorporate the head 12 height adjustment via movement of the head tooling 14 relative to the cradle 50. The alternative embodiments allow formation of multiple types of seams with a single head assembly 12.

In operation, a fully automatic duct forming line begins with sheet material 70 fed from a coil cradle to a feed which pulls the sheet material 70 from a roll. (See FIG. 9) The sheet material 70 then passes through a beader, notcher, and/or shear as necessary. The sheared sheets 70 then proceed through the present art pass through inline seam rollformer 10 where a pittsburgh, snap lock, or other type of seam is formed. Thereafter an edge flange rollformer is often utilized to flange the notched edge of the duct. If the duct requires insulation, a glue and insulation is applied and/or pinned to the sheared sheet 70. An automatic brake finishes the sheared sheets 70 by forming them into an "L" or full wrapper shape. Unique to the present art, all of the aforesaid is completed inline without a 90 degree transfer of any of the sheet material 70. Semi-automatic line operation may contain many of the aforesaid operations yet perform some of the aforesaid manually or with off line equipment.

As utilized with the aforesaid fully or semi automatic forming lines, the pass through inline seam rollformer 10 begins operation with the head assembly 12 in a home position 49 outside of the pass line 72 of the sheet material 70 flow through the apparatus 10. (See FIG. 10) When a leading 74 and trailing 76 edge of two adjacent sheets of material are positioned and aligned with the tooling 14 of the head 12, the head 12 begins lateral or horizontal movement across the two sheet materials 70 and rollforms the desired seam. The head 12 continues the aforesaid movement until the head 12 is substantially out of the pass line 72 of the sheet material 70. The head assembly 12 then drops below the pass line 72 and retracts under the sheet material 70 as the sheet material 70 moves on for further operations, including but not limited to the aforesaid edge flange rollformers, insulation applicators, or brakes. (See FIG. 11) When fully retracted and at the home position 49, the head assembly 12 is raised to a position, via said linear actuators 66, whereby another seam forming application may begin. If proper sheet material 70 feed rates are maintained, the sheets 70 which advanced during the head 12 retraction are positioned for seam formation. The pass through inline seam rollformer 10 continues the aforesaid operation without operator intervention.

Figure 22:
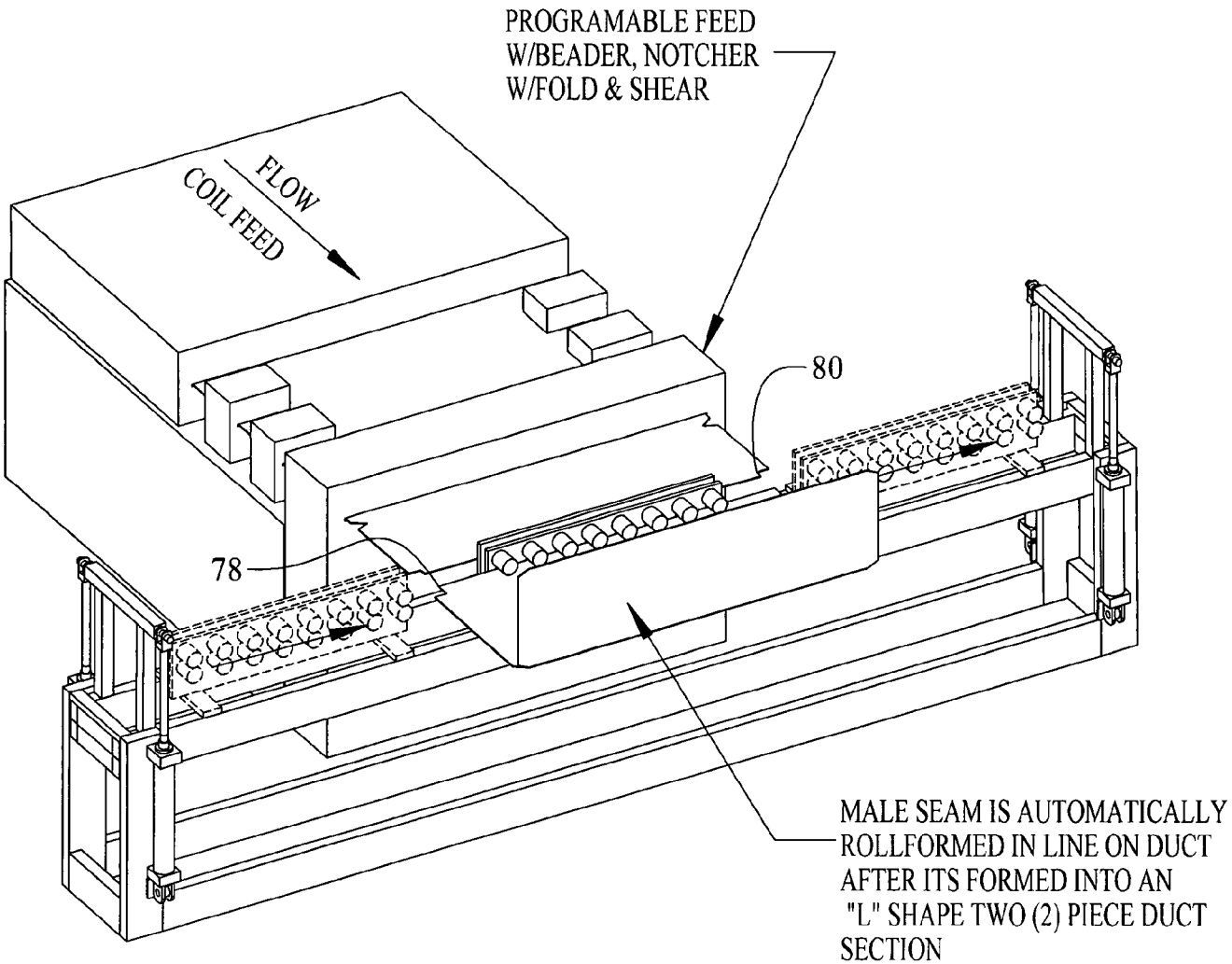
FIG. 22 is a front perspective view of the present art pass through inline seam rollformer fed with a feeding and notching system showing the head assembly as it forms the lock seams and how an "L" shaped duct section would exit the apparatus.
Figure 23:
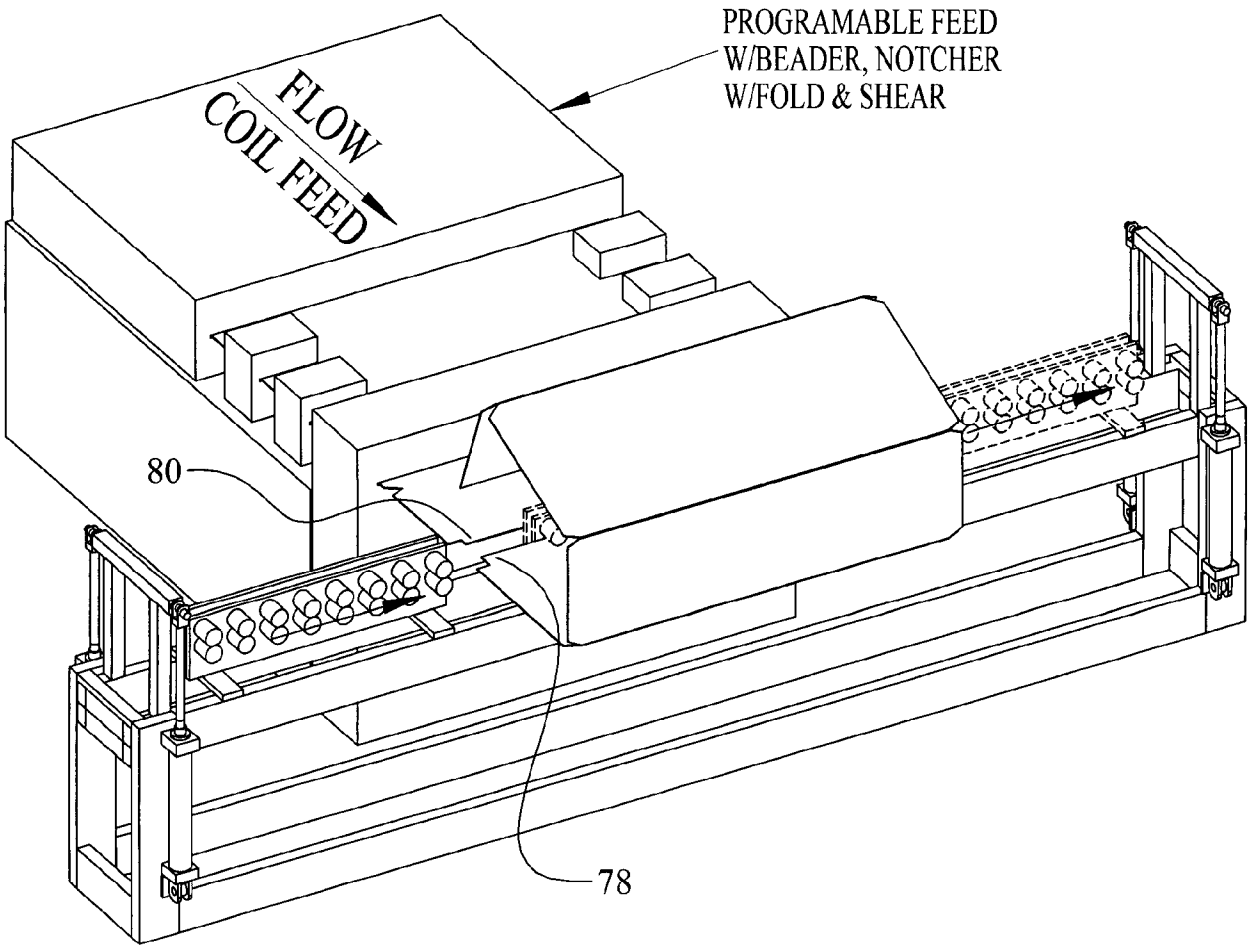
FIG. 23 is a front perspective view of the present art pass through inline seam rollformer fed with a feeding and notching system showing the head assembly as it forms the lock seams and how an full wrapper shaped duct section would exit the apparatus.
Figure 24:
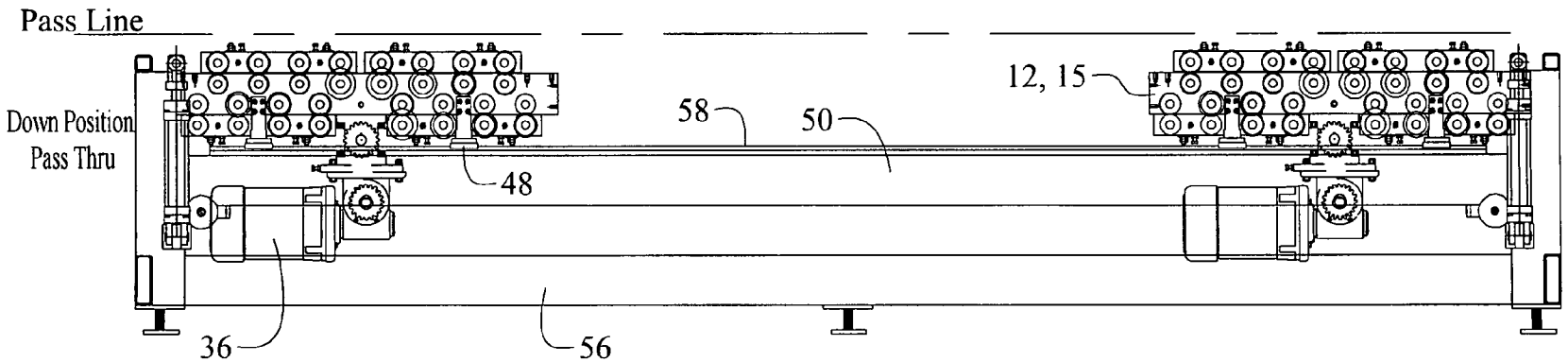
FIG. 24 is detailed front plan view of an alternative embodiment of the pass through inline seam rollformer with the head assembly in a lowered position.
Figure 25:
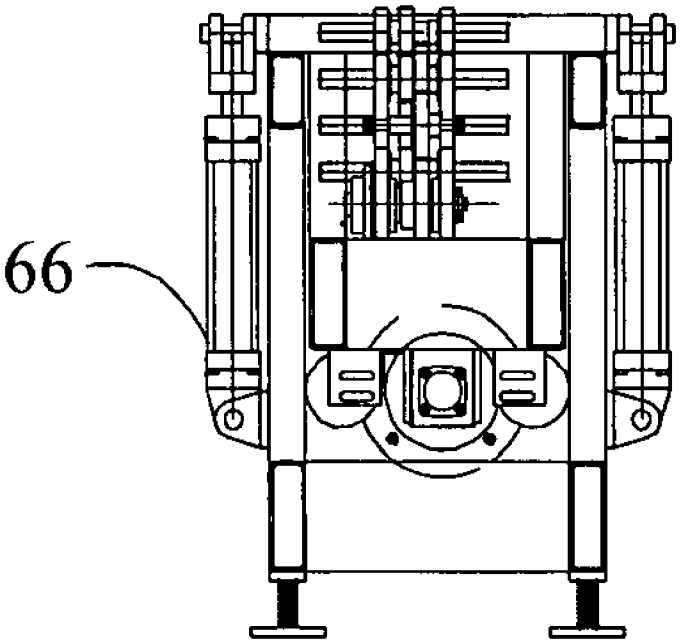
FIG. 25 is detailed left plan view of an alternative embodiment of the pass through inline seam rollformer with the head assembly in a lowered position.
Figure 26:
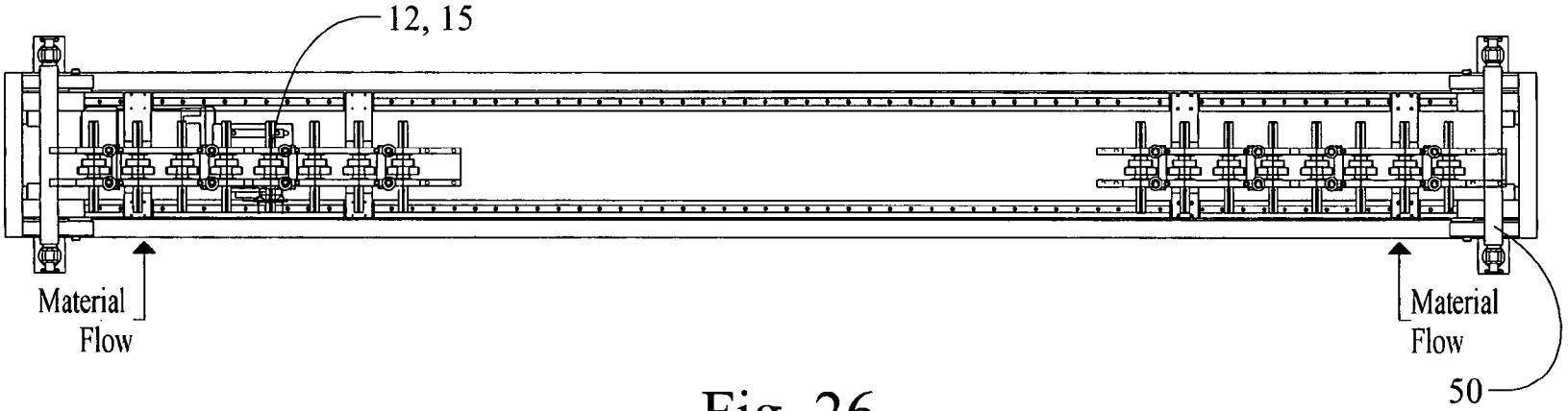
FIG. 26 is detailed top plan view of an alternative embodiment of the pass through inline seam rollformer.
Figure 27:
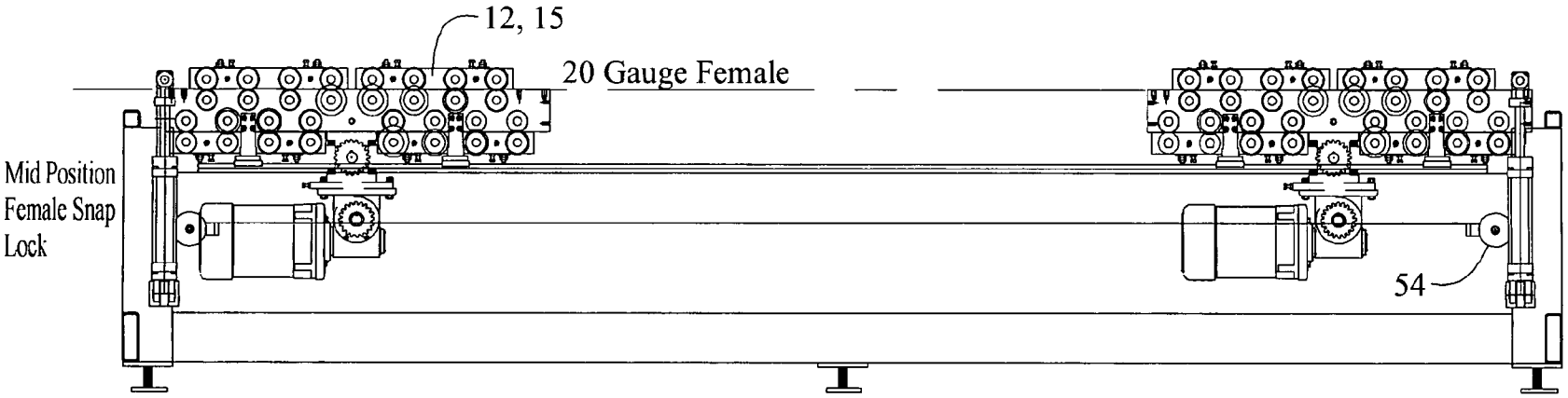
FIG. 27 is detailed front plan view of an alternative embodiment of the pass through inline seam rollformer with the head assembly in a mid position.
Figure 28:
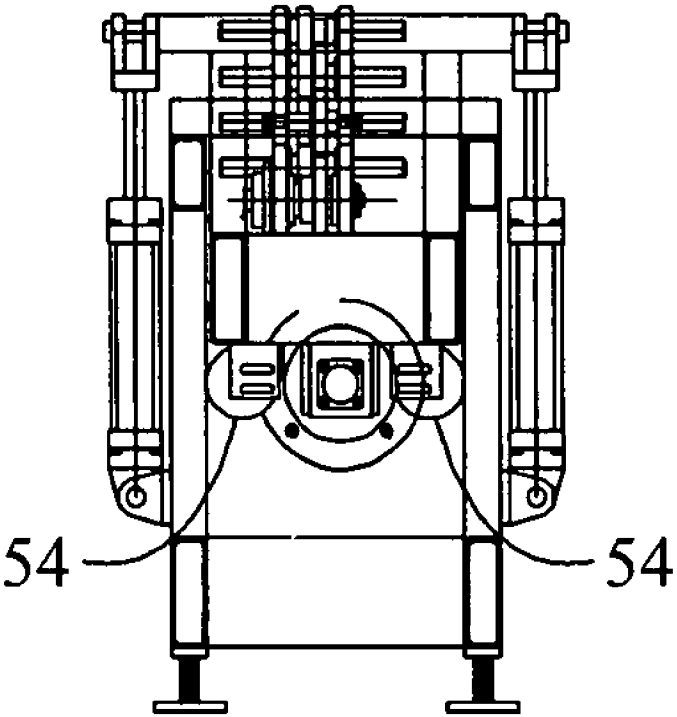
FIG. 28 is detailed left plan view of an alternative embodiment of the pass through inline seam rollformer with the head assembly in a mid position.
Figure 29:
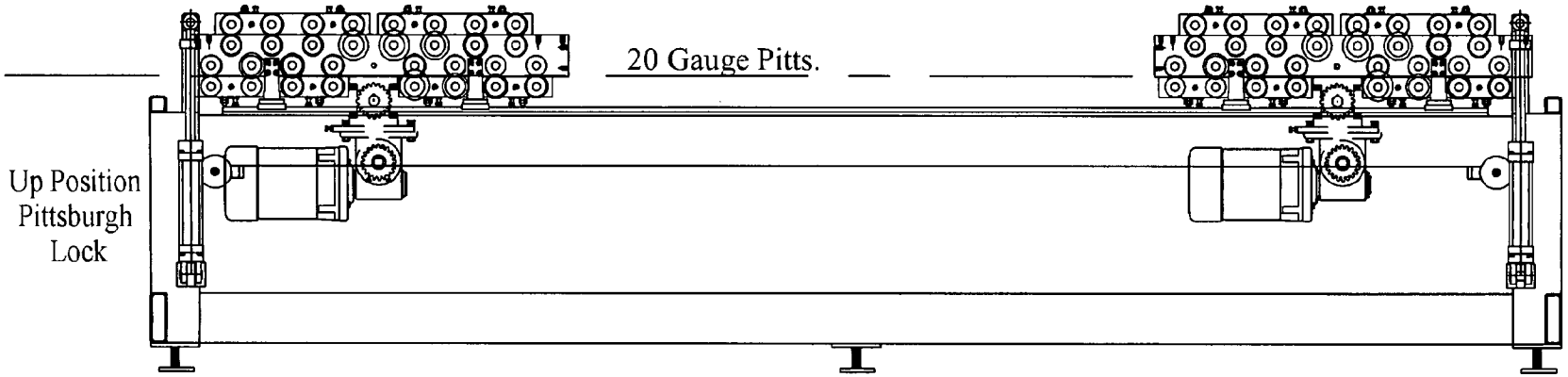
FIG. 29 is detailed front plan view of an alternative embodiment of the pass through inline seam rollformer with the head assembly in an elevated position.
Figure 30:
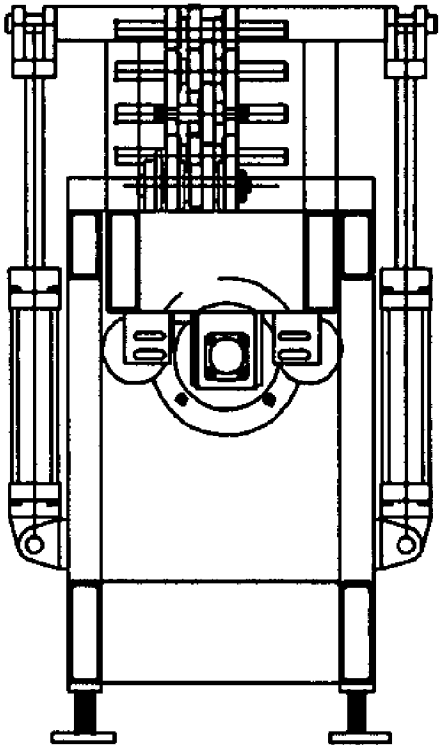
FIG. 30 is detailed left plan view of an alternative embodiment of the pass through inline seam rollformer with the head assembly in an elevated position.

The present art pass through inline seam rollformer 10 represents a compact and efficient apparatus for producing "L" shaped and full wrapper duct sections with lock seams 78, 80 formed simultaneously on both mating edges of the duct. As described, the sheet material is often beaded, notched, folded, and/or sheared prior to entering the pass through inline seam rollformer 10. FIG. 22 shows an "L" shaped duct section exiting the pass through inline seam rollformer 10 with the head 12 forming a male seam on the "L" shaped section and a female seam on the sheet material preceding the "L" shaped section. As contemplated, the "L" shape is formed with external brake equipment as the duct section exits the pass through inline seam rollformer 10. FIG. 23 shows the equivalent operation for a full wrapper duct section.

As described, the pass through inline seam rollformer 10 operation is activated and sequenced via a controller which maintains the material 70 feed rate, head assembly 12 movement rate across the material 70, and the proper positioning of the cradle 50 relative to the sheet material 70. Said controller may take a plurality of forms including but not limited to a microprocessor or computer, pneumatic or hydraulic logic, or other mechanical or electrical switch control.

From the foregoing description, those skilled in the art will appreciate that all objects of the present invention are realized. A pass through inline seam rollformer apparatus and method of use which maximizes the speed and efficiency of rollforming sheet material and minimizes the equipment size and footprint is shown and described. The present art eliminates the prior art 90 degree shuttling of material from the forming line which further minimizes the apparatus and line equipment footprint.

Having described the invention in detail, those skilled in the art will appreciate that modifications may be made to the invention and its method of use without departing from the spirit herein identified. Therefore, it is not intended that the scope of the invention be limited to the specific embodiments illustrated and described. Rather, it is intended that the scope of this invention be determined by the appended claims and their equivalents.

What is claimed is:

1. A pass through inline seam rollformer comprising:

a feed, a head assembly, a cradle, a frame, and one or more actuators; and said feed capable of feeding one or more sheet materials toward said head assembly; and said head assembly having one or more first tooling rollers with one or more first circumferential grooves or profiles capable of forming a first seam or a first profile upon a leading edge of one or more of the sheet materials; and said head assembly having one or more second tooling rollers having one or more second circumferential grooves or profiles capable of forming a second seam or a second profile upon a trailing edge of one or more of the sheet materials; and one or more motors rotationally coupled with said first or said second tooling rollers whereby a rotation is imparted to one or more of said first and said second tooling rollers; and said cradle having one or more rails or guideways upon which said head assembly moveably sits or rides and positioned to allow a lateral movement or travel of said head assembly across the leading edge and the trailing edge of the sheet material when said feed stops the leading edge and the trailing edge of the sheet material to a position that said first and said second tooling rollers may engage the leading or the trailing edge when forming the seam or the profile on the leading and the trailing edge; and said cradle configured to allow movement of said head outside of a pass line of the sheet material, the pass line represented by the sheet material; and said cradle moveably mated with said frame and raisable or retractable relative to said frame whereby said head assembly is raisable or retractable relative to the pass line of the sheet material; and said one or more actuators connected between said frame and said cradle whereby said cradle is raisable or retractable relative to said frame and the pass line.

2. The pass through inline seam rollformer as set forth in claim 1, further comprising:

said cradle having a substantially rectangular form and having one or more cradle rollers attached with said substantially rectangular form which contact and ride with said frame; and said cradle rollers allowing positioning and movability of said cradle relative to said frame; and said frame having one or more surfaces onto which said cradle rollers contact and ride.

3. The pass through inline seam rollformer as set forth in claim 2, further comprising:

one or more of said first or said second tooling rollers placed as one or more outboard rollers mounted upon one or more spindles; and said spindles coupled via one or more mating spindle gears mounted onto one or more of said spindles.

4. The pass through inline seam rollformer as set forth in claim 3, whereby:

said one or more motors are rotationally coupled with said tooling via one or more idler gears.

5. The pass through inline seam rollformer as set forth in claim 4, whereby:

said motor having a motor mount attached with said cradle; and a first sprocket mounted with said motor; and a second sprocket mounted with said head assembly; and a chain coupled between said first and second sprockets.

6. The pass through inline seam rollformer as set forth in claim 1, further comprising:

one or more linear bearings mounted with said head assembly which moveably seat upon said rail or guideway and allow said lateral movement or travel of said head with a minimum of application force.

7. The pass through inline seam rollformer as set forth in claim 5, further comprising:

one or more linear bearings mounted with said head assembly which moveably seat upon said rail or guideway and allow said lateral movement or travel of said head with a minimum of application force.

8. The pass through inline seam rollformer as set forth in claim 1, whereby:

said actuators are linear actuators.

9. The pass through inline seam rollformer as set forth in claim 7, whereby:

said actuators are linear actuators.

10. The pass through inline seam rollformer as set forth in claim 1, whereby:

said head assembly comprises a tandem assembly whereby one or more third tooling rollers is positioned in a substantially vertical relation relative to said first tooling rollers; and a third seam or a third profile may be formed by said actuators positioning said cradle at a different position relative to the pass line.

11. The pass through inline seam rollformer as set forth in claim 5, whereby:

said head assembly comprises a tandem assembly whereby one or more third tooling rollers is positioned in a substantially vertical relation relative to said first tooling rollers; and a third seam or a third profile may be formed by said actuators positioning said cradle at a different position relative to the pass line.

12. The pass through inline seam rollformer as set forth in claim 9, whereby:

said head assembly comprises a tandem assembly whereby one or more third tooling rollers is positioned in a substantially vertical relation relative to said first tooling rollers; and a third seam or a third profile may be formed by said actuators positioning said cradle at a different position relative to the pass line.

13. A method of forming a seam or profile on a sheet material, the steps comprising:

assembling a head assembly with one or more first tooling rollers and one or more second tooling rollers; and said first tooling rollers capable of forming a first seam or a first profile upon a leading edge of a sheet material; and said second tooling rollers capable of forming a second seam or a second profile upon a trailing edge of the sheet material; and coupling one or more motors rotationally with said first and said second tooling rollers; and imparting a rotation to one or more of said first or said second tooling rollers via one or more of said motors; and assembling a cradle having one or more rails or guideways upon which said head assembly sits or rides; and creating a lateral movement or travel of said head assembly when forming the first or the second seam or profile; and allowing said head to move outside of a pass line of said sheet material, said pass line represented by said sheet material; and assembling a frame and moveably mating said cradle with said frame whereby said cradle is raisable or retractable relative to said frame and said head assembly is raisable or retractable relative to the pass line of the sheet material; and connecting one or more actuators between said frame and cradle whereby said cradle is raisable or retractable relative to said frame; and positioning said head assembly at a home position outside of the pass line of the sheet material; and aligning and positioning and feeding a leading and a trailing edge of the sheet material with said first and said second tooling rollers of said head assembly; and holding the sheet material in a fixed position; and laterally moving said head assembly across the sheet material and the pass line whereby the first and the second seam or profile is rollformed; and continuing said lateral moving until said head assembly is substantially out of the pass line of the sheet material; and retracting said head assembly under the sheet material via said actuators; and moving the sheet material over said head assembly; and retracting said head assembly to substantially near said home position; and raising said head assembly via said actuators to said home position.

14. The method of forming a seam or profile on a sheet material as set forth in claim 13, the steps further comprising:

creating one or more surfaces upon said frame; and attaching one or more cradle rollers with said cradle; and contacting and riding said one or more cradle rollers with said surfaces.

15. The method of forming a seam or profile on a sheet material as set forth in claim 14, the steps further comprising:

creating one or more circumferential grooves or profiles within one or more of said first and said second tooling rollers; and mounting said first and said second tooling rollers upon one or more spindles; and mounting one or more spindle gears upon said spindles; and coupling said spindles via mating one or more of said spindle gears; and mounting one or more of said second tooling rollers onto said spindles opposite to said first tooling rollers.

16. The method of forming a seam or profile on a sheet material as set forth in claim 13, the steps further comprising:

creating one or more circumferential grooves or profiles within one or more of said first or said second tooling rollers; and mounting said first and said second tooling rollers upon one or more spindles; and mounting one or more spindle gears upon said spindles; and coupling said spindles via mating one or more of said spindle gears.

17. The method of forming a seam or profile on a sheet material as set forth in claim 16, the steps further comprising:

mounting one or more of said motors with a motor mount attached with said cradle; and mounting a first sprocket with said motor; and mounting a second sprocket with said head assembly; and coupling said sprockets.

18. The method of forming a seam or profile on a sheet material as set forth in claim 17, the steps further comprising:

mounting one or more linear bearings with said head assembly; and seating said linear bearings upon one or more of said rails or guideways whereby a minimum of an application force is necessary for said lateral movement.

19. The method of forming a seam or profile on a sheet material as set forth in claim 18, the steps further comprising:

selecting said actuators as one or more linear actuators.

20. The method of forming a seam or profile on a sheet material as set forth in claim 19, the steps further comprising:

placing a third tooling in a substantially vertical relation relative to said first tooling rollers with said head assembly whereby a tandem assembly is formed; and positioning said cradle at a different position relative to the pass line; and forming a different type of the seam or profile with said third tooling.

* * * * *